US009333672B1

(12) United States Patent
Gavish

(10) Patent No.: US 9,333,672 B1
(45) Date of Patent: May 10, 2016

(54) HARDENABLE MATERIAL STRUCTURE CONSTRUCTION APPARATUS AND METHOD

(71) Applicant: Mordechay Gavish, Rehovot (IL)

(72) Inventor: Mordechay Gavish, Rehovot (IL)

(73) Assignee: S.G.L. GAVISH YIZUM U'VNIA, LTD., Bnei Berak (IL)

( * ) Notice: Subject to any disclaimer, the term of this patent is extended or adjusted under 35 U.S.C. 154(b) by 0 days.

(21) Appl. No.: 14/682,133

(22) Filed: Apr. 9, 2015

(51) Int. Cl.
*B28B 7/24* (2006.01)
*E04B 1/16* (2006.01)
*E04B 2/84* (2006.01)

(52) U.S. Cl.
CPC ..... *B28B 7/248* (2013.01); *E04B 1/162* (2013.01); *E04B 2/847* (2013.01); *E04B 2103/02* (2013.01)

(58) Field of Classification Search
CPC .. B29C 33/302; B29C 33/303; B29C 33/304; B29C 33/307; E04B 2/84; E04B 2/842; E04B 2/847; E04B 1/10; E04B 1/12; E04B 2002/0243
USPC ..... 52/275, 251, 424–428, 379; 249/190–192, 43–45, 49, 188
See application file for complete search history.

(56) References Cited

U.S. PATENT DOCUMENTS 1,069,821 A 8/1913 Sherwood
1,991,256 A 2/1935 Muntz
2,029,082 A 1/1936 Odam
2,248,348 A 7/1941 Hall
2,383,864 A 8/1945 Judkins
3,263,958 A * 8/1966 Cox ..... E04G 17/06 249/190
3,284,043 A 11/1966 Campo
3,648,961 A * 3/1972 Farrow ..... E04G 17/0652 249/216
3,661,354 A * 5/1972 Dagiel ..... E04G 11/10 249/192
3,664,630 A * 5/1972 Maynen ..... E04G 9/10 249/112
3,985,329 A 10/1976 Liedgens
4,185,805 A * 1/1980 Ewing ..... E04G 11/065 249/192
4,888,931 A 12/1989 Meilleur
4,936,540 A 6/1990 Boeshart
4,967,528 A 11/1990 Doran
5,140,794 A 8/1992 Miller
6,113,060 A 9/2000 Wilde
2001/0027630 A1 10/2001 Moore, Jr. et al.
2005/0218291 A1 10/2005 Musk et al.
2008/0017783 A1 * 1/2008 Vanagan ..... E04G 17/045 249/192

* cited by examiner

*Primary Examiner* — Brian Glessner
*Assistant Examiner* — Adam Barlow
(74) *Attorney, Agent, or Firm* — Simon Kahn; Chanoch Kahn

(57) ABSTRACT

A temporary building hardenable material construction apparatus, constituted of: a freestandable support frame; at least one extension member; a first and second enclosure member positioned in parallel such that a space is defined therebetween, wherein the freestandable support frame is juxtaposed with the outer face of the first enclosure member or the outer face of the second enclosure member, wherein each extension member extends through the first and second enclosure member such that the first end thereof extends past the first enclosure member or the second end thereof extends past the second enclosure member, and wherein the at least one extension member is secured to the freestandable support frame.

28 Claims, 18 Drawing Sheets

HARDENABLE MATERIAL STRUCTURE CONSTRUCTION APPARATUS AND METHOD

TECHNICAL FIELD

The invention relates generally to the field of construction and in particular to a hardenable material structure construction apparatus and method.

BACKGROUND

Concrete has been used for construction since ancient times and in recent years several different types of hardenable material, i.e. liquid material which harden into a solid material, which provide similar or superior properties to concrete, have been developed. Traditionally, in order to construct a concrete wall a metal grid is erected and a form is built for the concrete with a large number of wooden beams on both sides, the wooden beams connected to each other and otherwise reinforced so as not to buckle when the concrete is poured. Concrete is then poured between the erected wooden beams and left to harden. After the concrete hardens, the wooden beams are removed thereby exposing the concrete wall. The inside of the concrete wall is then typically insulated with thermal insulation material and a cinder block wall is erected over the thermal insulation. Additionally, a facade is built on the outer side of the concrete wall, generally secured to the concrete wall with plaster.

Unfortunately, the traditional method of concrete construction suffers from several disadvantages. Firstly, erecting the many wooden beams to produce a form for the concrete requires significant manual labor, which increases cost and complexity. Secondly, providing thermal insulation within the building creates thermal bridges at the ceiling/floor of each level. Although methods for thermally insulating the outer side of the concrete wall do exist, outdoor thermal insulation adds costs and complexity due to the unique challenges of outdoor construction. Additionally, the plaster securing the insulation to the outside of the concrete wall is porous and any water droplets which enter the plaster will expand when heated during the day, thereby causing an expansion of the plaster. Such an expansion will apply pressure to the facade, which can cause damage thereto. In the event that the facade is made of stone, the stones can fall off the building, which can cause damage and bodily harm. The same disadvantage applies for a facade directly secured to the concrete wall with plaster. A third disadvantage is that a stone facade secured with plaster is only weakly secured to the concrete wall, thereby risking that the stones can fall off.

Although many premade concrete forms have been developed to reduce the amount of wooden beam construction on site, the other disadvantages still remain. Additionally, although wooden beam construction is reduced, each concrete form type presents new challenges which increase cost and complexity.

It is therefore an object of the present disclosure to overcome at least part of the disadvantages of the prior art.

SUMMARY OF THE INVENTION

Accordingly, it is a principal object of the present invention to overcome disadvantages of prior art methods and arrangements of hardenable material construction. This is provided in one embodiment by a temporary hardenable material construction apparatus comprising: a first freestandable support frame; at least one extension member, the at least one extension member exhibiting a first end and a second end opposing the first end; at least one first enclosure member exhibiting an inner face and an outer face opposing the inner face; and at least one second enclosure member exhibiting an inner face and an outer face opposing the inner face, the at least one second enclosure member positioned in parallel with the at least one first enclosure member such that a space is defined between the inner face of the at least one first enclosure member and the inner face of the at least one second enclosure member, wherein the first freestandable support frame is juxtaposed with the outer face of the at least one first enclosure member or the outer face of the second enclosure member, wherein the at least one extension member extends through the first enclosure member and the second enclosure member such that the first end of the at least one extension member extends past the outer face of the first enclosure member or the second end of the at least one extension member extends past the outer face of the second enclosure member, and wherein the at least one extension member is secured to the first freestandable support frame.

In one embodiment, the temporary hardenable material construction apparatus further comprises a second freestandable support frame, the first freestandable support frame juxtaposed with the outer face of the at least one first enclosure member and the second freestandable support frame juxtaposed with the outer face of the at least one second enclosure member, wherein the first end of the at least one extension member is secured to the first freestandable support frame and the second end of the at least one extension member is secured to the second freestandable support frame.

In another independent embodiment, a hardenable material structure is provided, the hardenable material structure comprising: a plurality of extension members, each of the plurality of extension members exhibiting a first end and a second end opposing the first end; a first enclosure member exhibiting an inner face and an outer face opposing the inner face; and a second enclosure member exhibiting an inner face and an outer face opposing the inner face, the second enclosure member positioned in parallel with the first enclosure member such that a space is defined between the inner face of the first enclosure member and the inner face of the second enclosure member, the space filled with a wall layer of hardenable material; wherein each of the plurality of extension members extends through the first enclosure member and the second enclosure member, and wherein the first enclosure member comprises: a plurality of facade members; and a plurality of facade securing elements, each of the plurality of facade securing elements is secured to a perimeter of a respective one of the plurality of facade members, and wherein each of the plurality of extension members extends through a respective one of the plurality of facade securing elements.

In one embodiment, each of the plurality of facade securing elements comprises a strip, wherein each of the plurality of facade members comprises a slab, each of the plurality of slabs exhibiting a first face, a second face opposing the first face, a first side extending from the first face to the second face and a second side opposing the first side, each of the first side and the second side exhibiting a slit therealong, the slit configured to receive a respective one of the plurality of strips, wherein the first side of each of the plurality of slabs faces the second side of another of the plurality of slabs, a respective one of the plurality of strips disposed within the slit of the first side of the respective slab and within the slit of the second side of the another respective slab, each of the plurality of extension members extending through a respective one of the plurality of strips.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PREFERRED EMBODIMENTS

Figure 1A:
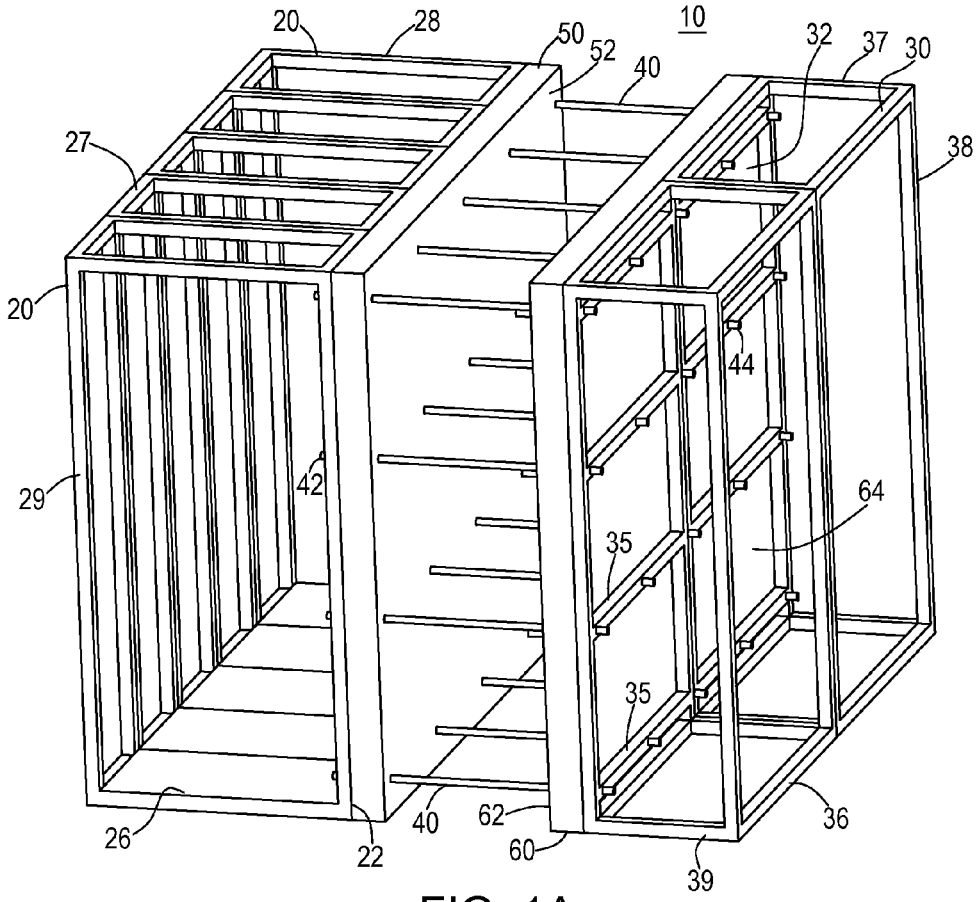
FIGS. 1A-1B illustrate various high level views of a temporary hardenable material construction apparatus comprising freestandable support frames, according to certain embodiments.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1B:
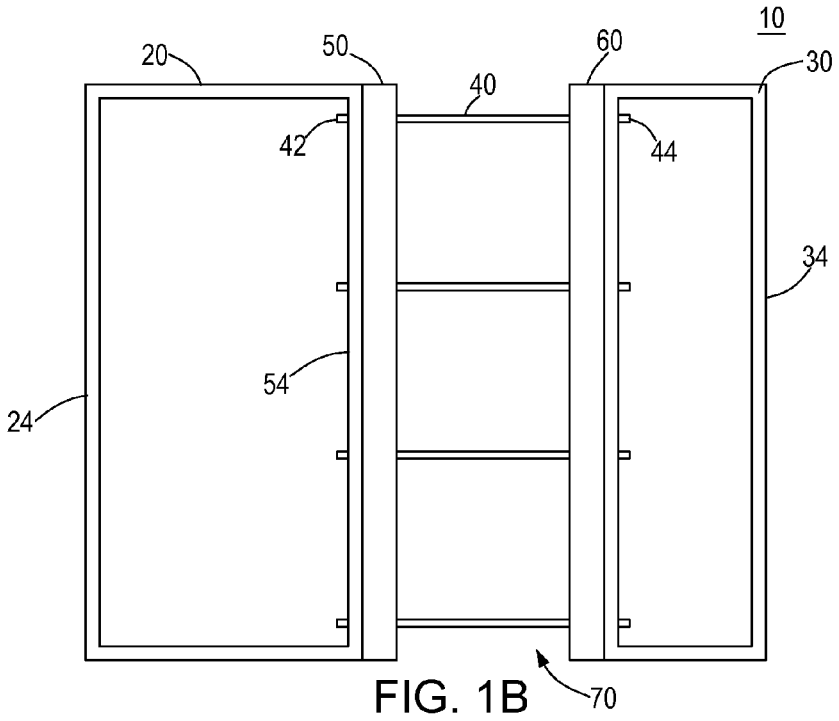

FIG. 1A illustrates a high level perspective view of a temporary hardenable material construction apparatus 10 and FIG. 1B illustrates a high level side view of temporary hardenable material construction apparatus 10, FIGS. 1A-1B being described together.

Temporary hardenable material construction apparatus 10 comprises: a plurality of freestandable support frames 20, each exhibiting a first face 22, a second face 24 opposing first face 22, a plurality of receiving members 25 (not shown) extending across first face 22, a base portion 26, a top portion 27 opposing base portion 26, a first side 28 and a second side 29 opposing first side 28; a plurality of freestandable support frames 30, each exhibiting a first face 32, a second face 34 opposing first face 32, a plurality of receiving members 35 extending across first face 32, a base portion 36, a top portion 37 opposing base portion 36, a first side 38 and a second side 39 opposing first side 38; a plurality of extension members 40, each exhibiting a first end 42 and a second end 44 opposing first end 42; an enclosure member 50, exhibiting an inner face 52 and an outer face 54 opposing inner face 52; and an enclosure member 60, exhibiting an inner face 62 and an outer face 64 opposing inner face 62.

The term 'freestandable', as used herein, means that the support frame is able to stand on its own when placed on a surface without any additional supports securing it to another support structure or the ground. In one embodiment, each freestandable support frame 20 is constituted of any of, or a combination of, wood, plastic and metal. Receiving members 25, 35 of each respective freestandable support frame 20, 30 are illustrated as extending horizontally across respective first face 22, 32 thereof, however this is not meant to be limiting in any way. In another embodiment, receiving members 25, 35 extend vertically across the respective first face 22, 32, without exceeding the scope. In yet another embodiment, receiving members 25, 35 of each respective freestandable support frame 20, 30 are provided as a single board covering the respective first face 22, 32, without exceeding the scope.

First freestandable support members 20 and second freestandable support members 30 are each illustrated as being generally rectangular shaped, however this is not meant to be limiting in any way. Particularly, first freestandable support members 20 and second freestandable support members 30 are shaped in accordance to the shapes of enclosure member 50 and enclosure member 60, which can be provided in any shape according to the construction plans.

First side 28 and second side 29 of each freestandable support frame 20 extends from first face 22 to second face 24 and from base portion 26 to top portion 27. In one embodiment, first sides 28 and second sides 29 are each open, i.e. a person can walk therethrough. In another embodiment, base portion 26 of each freestandable support frame 20 is a generally flat and closed surface. In one embodiment, the distance between first face 22 and second face 24 of each freestandable support frame 20 is about 120 centimeters. Particularly, the distance between first face 22 and second face 24 is arranged such that two people can both work side by side within a single freestandable support frame 20. In another embodiment, the distance between first side 28 and second side 29 of each freestandable support frame 20 is about 60 centimeters. First side 38 and second side 39 of each freestandable support frame 30 extends from first face 32 to second face 34 and from base portion 36 to top portion 37. In one embodiment, the distance between first face 32 and second face 34 of each freestandable support frame 30 is about 60 centimeters. In another embodiment, the distance between first side 38 and second side 39 of each freestandable support frame 30 is about 120 centimeters. In one embodiment, each of first faces 22 and 32, second faces 24 and 34, base portions 26 and 36, top portions 27 and 37, first sides 28 and 28, and second sides 29 and 39 are generally rectangular.

As will be described below, in one embodiment each extension member 40 exhibits a plurality of grooves. Enclosure member 50 is positioned in parallel with enclosure member 60 such that a space 70 is defined between inner face 52 of enclosure member 50 and inner face 62 of enclosure member 60. Thus, inner face 52 is defined as the face of enclosure member 50 which faces, and defines, space 70 and outer face 54 is defined as the face of enclosure member 50 which faces away from space 70. Similarly, inner face 62 is defined as the face of enclosure member 60 which faces, and defines, space 70 and outer face 64 is defined as the face of enclosure member 60 which faces away from space 70. As will be described below, a hardenable material is arranged to be poured into space 70.

First face 22 of each freestandable support frame 20 is juxtaposed with outer face 54 of enclosure member 50 and in one embodiment is flush therewith. As illustrated, first face 22 of each freestandable support frame 20 is substantially completely covered by outer face 54 of enclosure member 50. In one embodiment, as illustrated, first face 22 is rectangular shaped, with the sides of first face 22 which are defined by first side 28 and second side 29 being longer than the sides of first face 22 which are defined by base portion 26 and top portion 27. First side 28 of each freestandable support frame 20 faces second side 29 of an adjacently positioned freestandable support frame 20 so as to form a row of freestandable support frames 20. In one embodiment, each freestandable support frame 20 is secured to an adjacent freestandable support frame 20. First face 32 of each freestandable support frame 30 is juxtaposed with outer face 64 of enclosure member 60 and in one embodiment is flush therewith. As illustrated, first face 32 of each freestandable support frame 30 is substantially completely covered by outer face 64 of enclosure member 60. In one embodiment, as illustrated, first face 32 is rectangular shaped, with the sides of first face 32 which are defined by first side 38 and second side 39 being longer than the sides of first face 32 which are defined by base portion 36 and top portion 37. First side 38 of each freestandable support frame 30 faces second side 39 of an adjacently positioned freestandable support frame 30 so as to form a row of freestandable support frames 30. In one embodiment, each freestandable support frame 30 is secured to an adjacent freestandable support frame 30.

Each extension member 40 extends through enclosure member 50, space 70 and enclosure member 60 such that first end 42 of each extension member 40 extends past outer face 54 of enclosure member 50 and second end 44 of each extension member 40 extends past outer face 64 of enclosure member 60. Additionally, first end 42 of each extension member 40 is secured to a receiving member 25 of a respective one of freestandable support frames 20. In one embodiment, where freestandable support frames 20 are constituted of wood or plastic, first end 42 extends through the respective receiving member 25 and is secured thereto on one or both sides thereof. In another embodiment, where freestandable support frames 20 are constituted of metal, first end 42 is welded to the respective receiving member 25. Additionally, second end 44 of each extension member 40 is secured to a receiving member 35 of a respective one of freestandable support frames 30. In one embodiment, where freestandable support frames 30 are constituted of wood or plastic, second end 44 extends through the respective receiving member 35 and is secured thereto on one or both sides thereof. In another embodiment, where freestandable support frames 30 are constituted of metal, second end 44 is welded to the respective receiving member 35. In one embodiment, 24 extension members 40 are secured to each freestandable support frame 20.

In one embodiment, as will be described further below in relation to temporary hardenable material construction apparatus 300, a steel grid assembly may be disposed within space 70. In another embodiment, water and sanitation pipes and electric wiring may be disposed within space 70 prior to pouring the hardenable material described below.

Temporary hardenable material construction apparatus 10 is illustrated and described as comprising a plurality of freestandable support frames 20 and a plurality of freestandable support frames 30, however this is not meant to be limiting in any way and a single freestandable support frame 20 and a single freestandable support frame 30 may be provided without exceeding the scope. Advantageously, utilizing a plurality of freestandable support frames 20, 30 allows for the use of smaller support frames which are light, easily portable and do not require a complex manufacturing process.

Figure 1C:
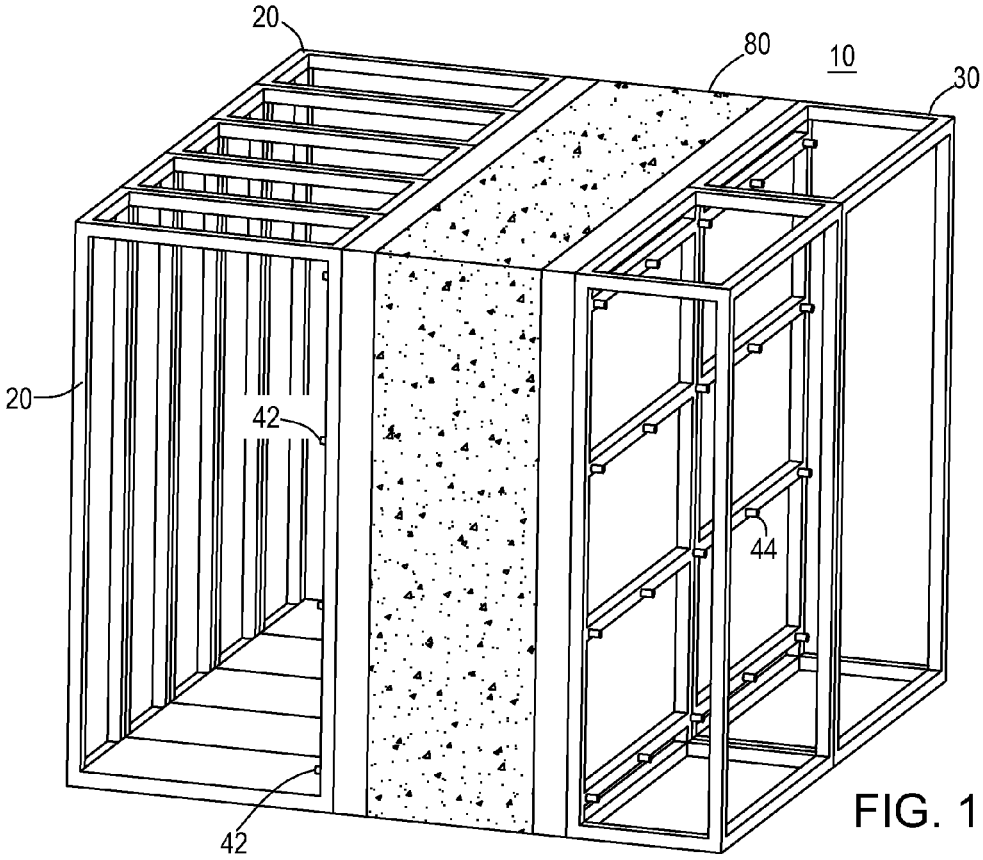
FIG. 1C illustrates a high level perspective view of the temporary hardenable material construction apparatus of FIGS. 1A-1B further comprising hardenable material, according to certain embodiments.

As illustrated in FIG. 1C, a hardenable material 80 is poured into space 70. In one embodiment, hardenable material 80 comprises concrete. In another embodiment, hardenable material 80 comprises any fluidic material which hardens. For clarity, FIGS. 1A-1C are illustrated where space 70 is open at the ends of enclosure members 50, 60, however temporary hardenable material construction apparatus 10 is particularly contemplated as comprising means for containing hardenable material 80 within space 70. In one embodiment, as will be described below in relation to temporary hardenable material construction apparatus 500, four perpendicular spaces 70 are constructed thereby creating a single enclosed space for hardenable material 80. In another embodiment, the ends of space 70 are covered with material to hold hardenable material 80 therein.

Figure 1D:
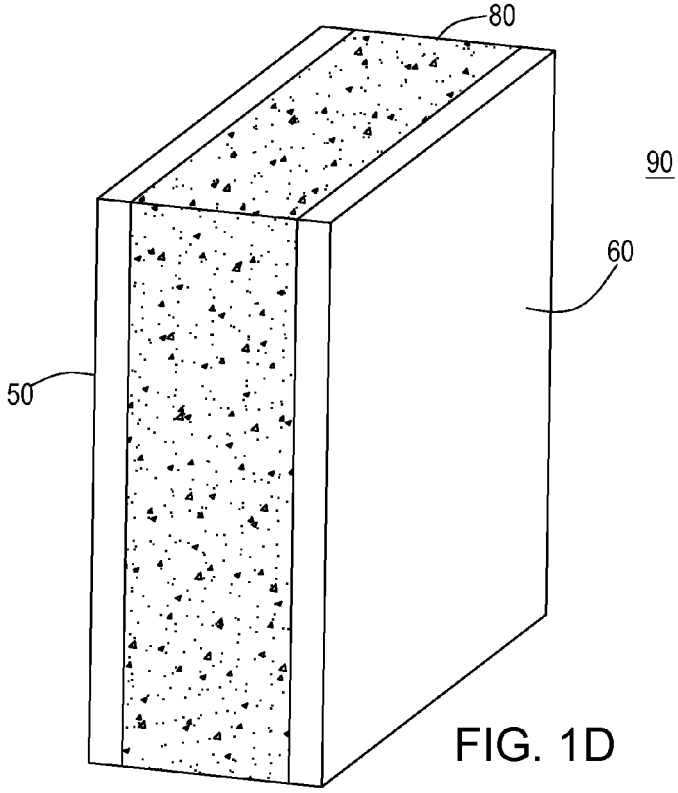
FIG. 1D illustrates a high level perspective view of a wall of the hardenable material of FIG. 1C, without the freestandable support frames of FIGS. 1A-1B, according to certain embodiments.

As illustrated in FIG. 1D, after hardenable material 80 is poured into space 70, and is allowed to harden, freestandable support frames 20, 30 are removed. First end 42 and second end 44 of each extendable member 40 is then sawed off. A wall 90 is thus provided, comprising enclosure members 50, 60 and hardened hardenable material 80. Advantageously, the hardened hardenable material 80 doesn't have to be covered with additional wall sections, since enclosure members 50, 60 are already attached thereto. However, in another embodiment, one or both of enclosure members 50, 60 can be removed after hardenable material 80 hardens, so the hardened hardenable material 80 can be covered with other materials or left exposed. As will be described further below, in one embodiment enclosure member 50 is secured to the hardened hardenable material 80 by extending members 40 and enclosure member 60 is secured to the hardened hardenable material by protrusions extending therefrom. Further advantageously, freestandable support frames 20, 30 can be reused since they do not need to be disassembled to be removed from wall 90.

Temporary hardenable material construction apparatus 10 has been describe and illustrated as comprising one or more freestandable support frames 20 and one or more freestandable support frames 30, however this is not meant to be limiting in any way. In another embodiment, freestandable support frames 30 are not provided and extension members 40 are secured to freestandable support frames 20. In another embodiment, freestandable support frames 20 are not provided and extension members 40 are secured to freestandable support frames 30.

In one embodiment (not shown), enclosure member 50 comprises: a plurality of facade members; and a plurality of facade securing elements, each of the plurality of facade securing elements secured to a perimeter of a respective one of the plurality of facade members. First end 42 of each extension member 40 extends through a respective one of the plurality of facade securing elements. The facade members are members which form a facade, such as stones. The facade members can exhibit any shape and dimensions which are desired. Optionally, the perimeter of each facade member, i.e. the sides thereof, exhibit a plurality of insertion holes, each the insertion holes containing a respective one of the plurality of facade securing elements. The facade securing elements are each designed to exhibit an opening to receive therethrough an extension member 40. Enclosure member 50 is formed by positioning the facade members along a single plane, each facade member optionally secured to an adjacent facade member with appropriate material, such as mortar.

Figure 2A:
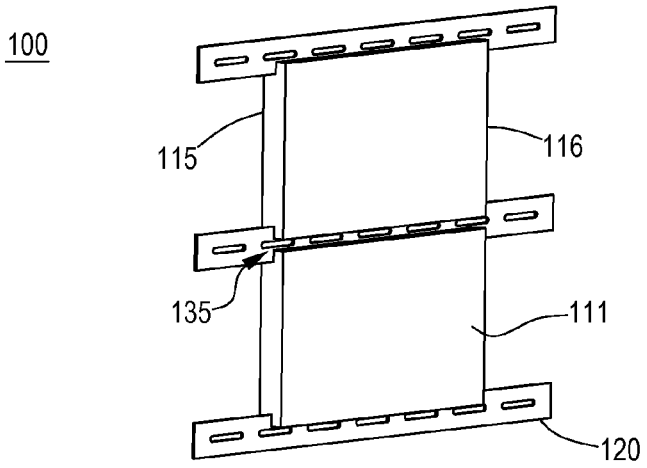
FIGS. 2A-2B illustrate various high level views of an enclosure member comprising a plurality of slitted slabs and a plurality of strips disposed therewithin, according to certain embodiments.
Figure 2B:
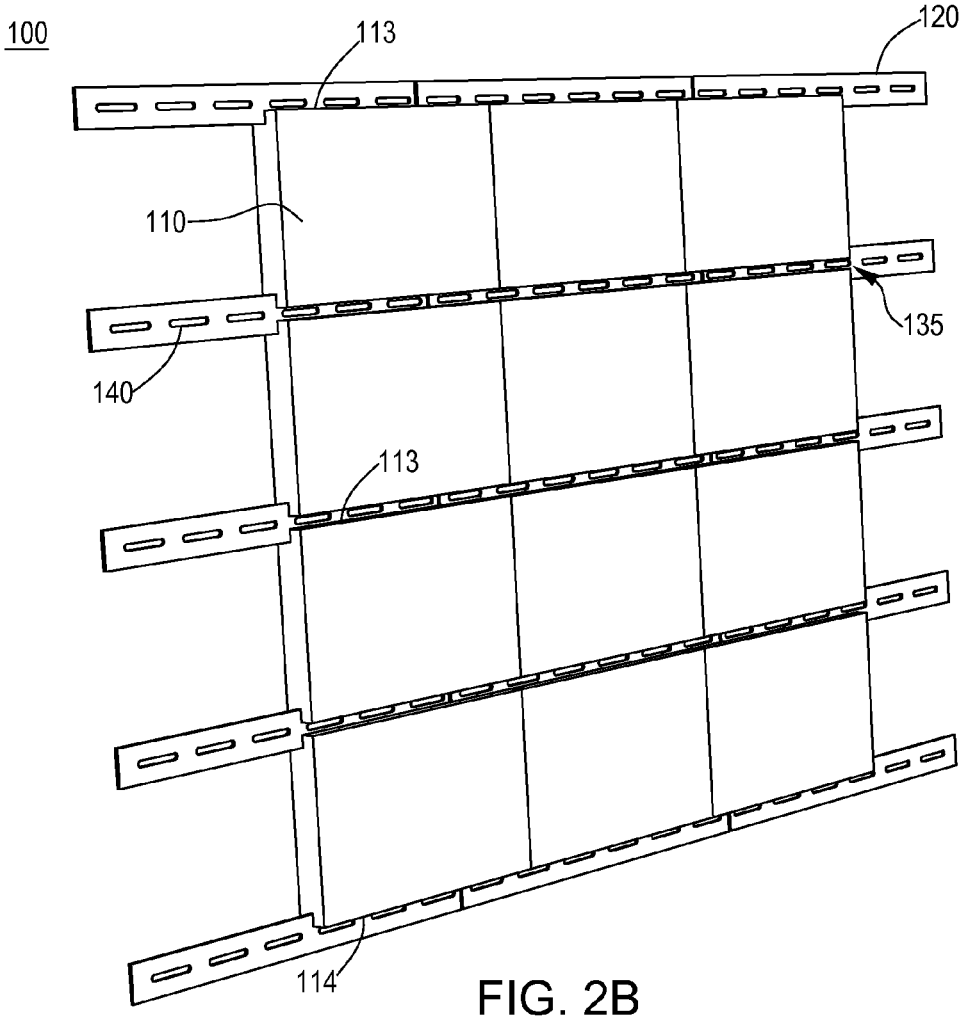
Figure 2C:
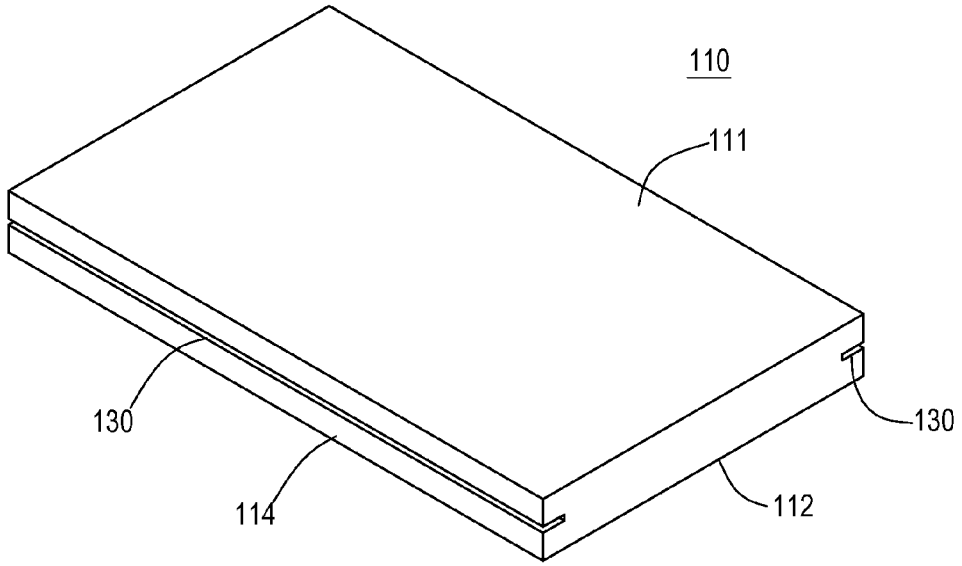
FIG. 2C illustrates a high level view of a slab of FIGS. 2A-2B, according to certain embodiments.
Figure 2D:
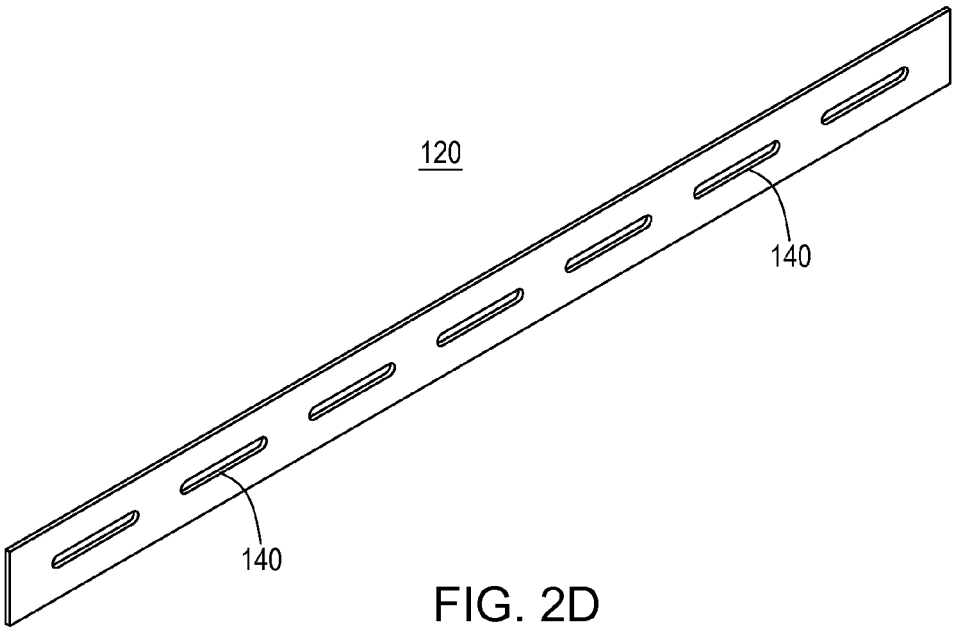
FIG. 2D illustrates a high level view of a strip of FIGS. 2A-2B, according to certain embodiments.
Figure 2E:
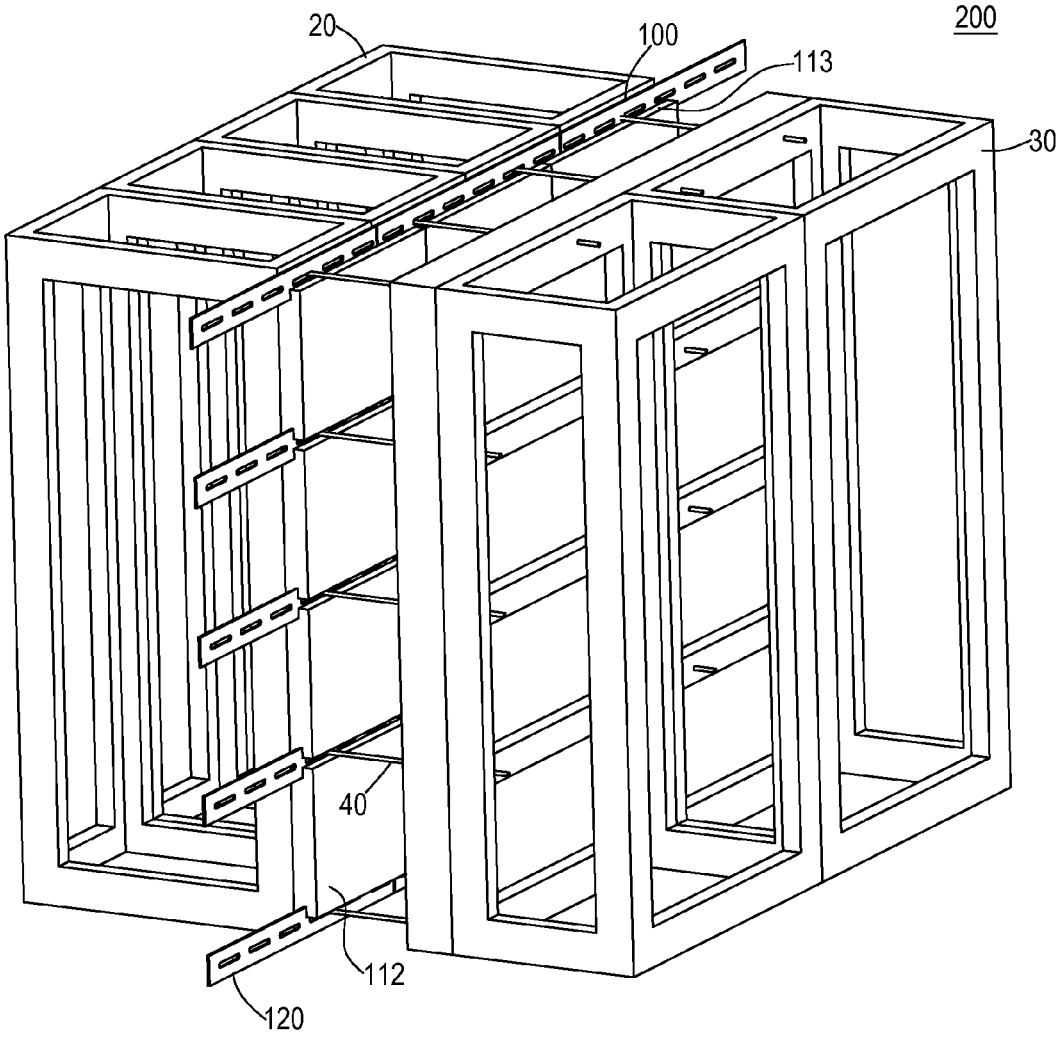
FIG. 2E illustrates a high level view of a temporary hardenable material construction apparatus comprising the enclosure member of FIGS. 2A-2B, according to certain embodiments.
Figure 2F:
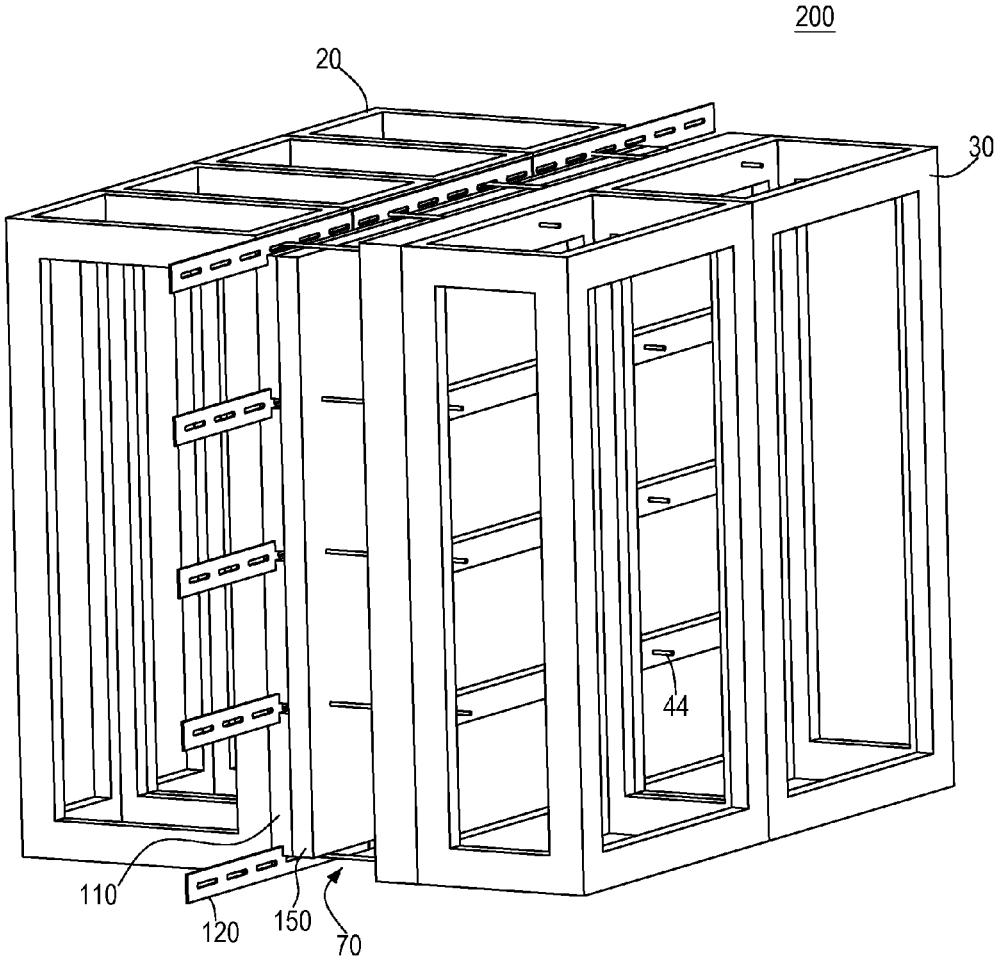
FIG. 2F illustrates a high level view of the temporary hardenable material construction apparatus of FIG. 2E, further comprising an insulation layer, according to certain embodiments.
Figure 2G:
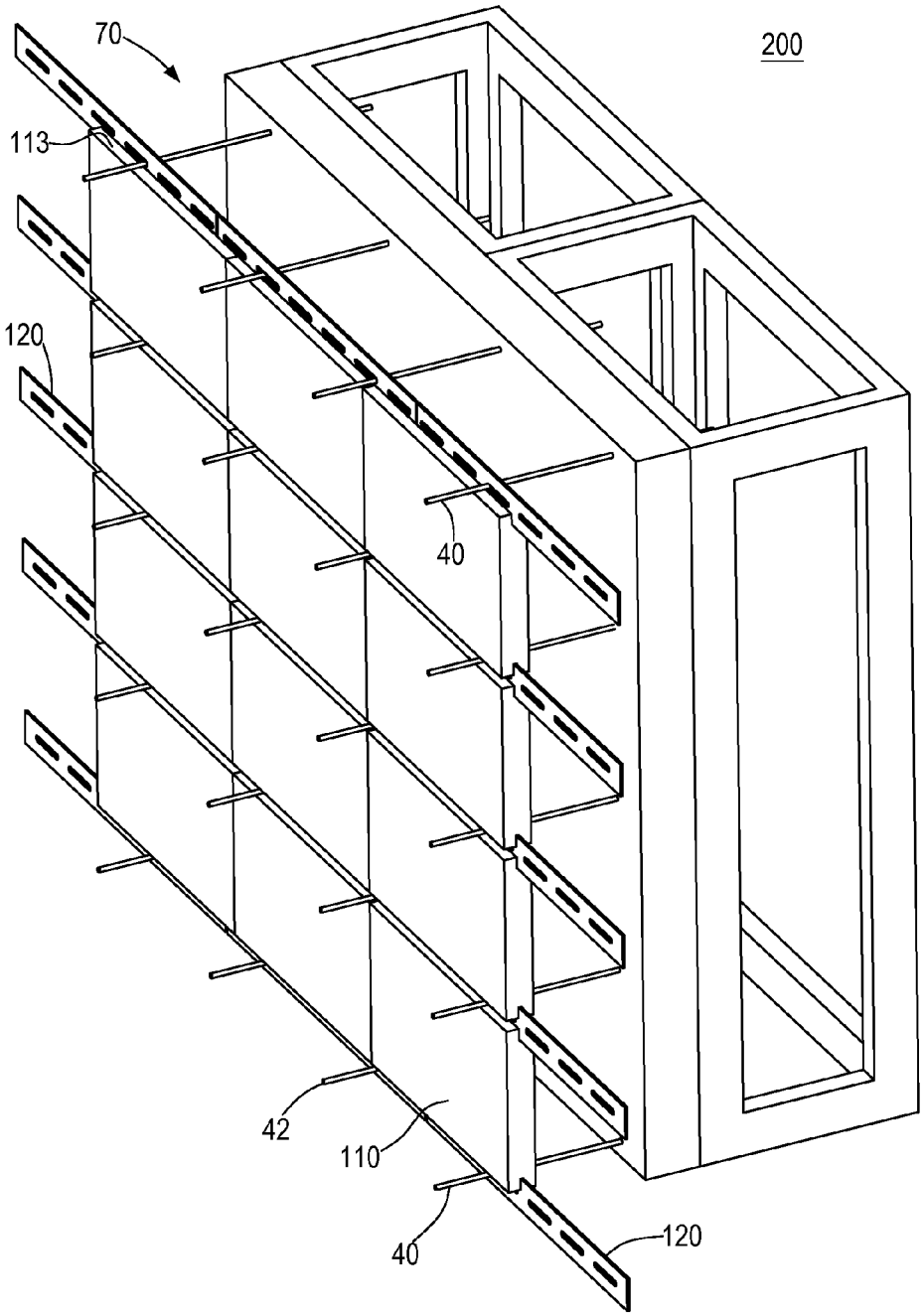
FIG. 2G illustrates a high level view of a portion of the temporary hardenable material construction apparatus of FIG. 2E, according to certain embodiments.
Figure 2H:
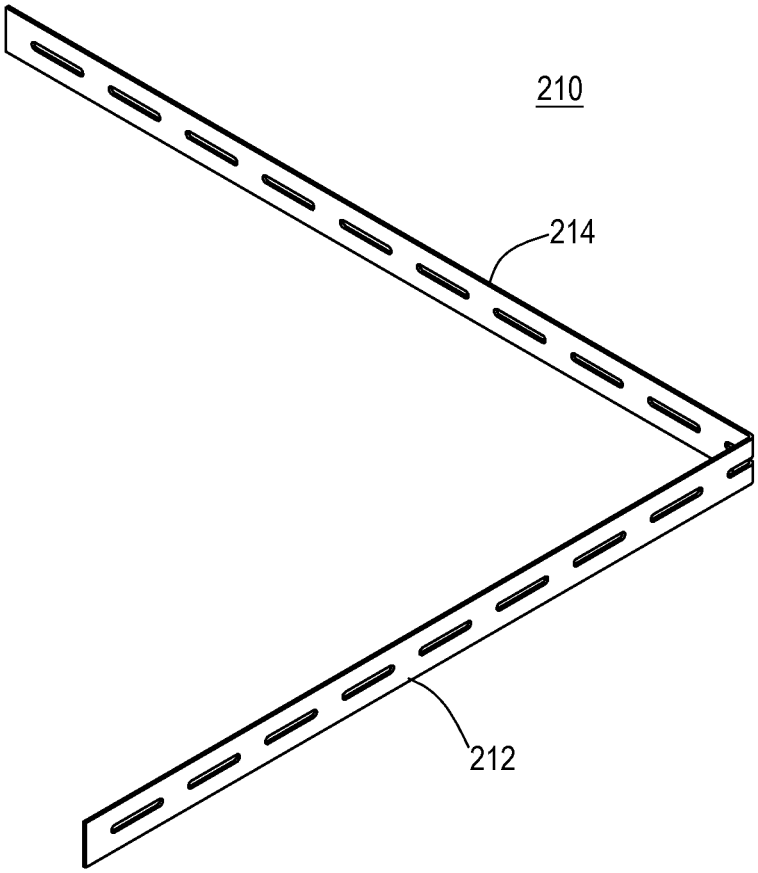
FIG. 2H illustrates a high level view of an L-shaped corner member, according to certain embodiments.
Figure 2I:
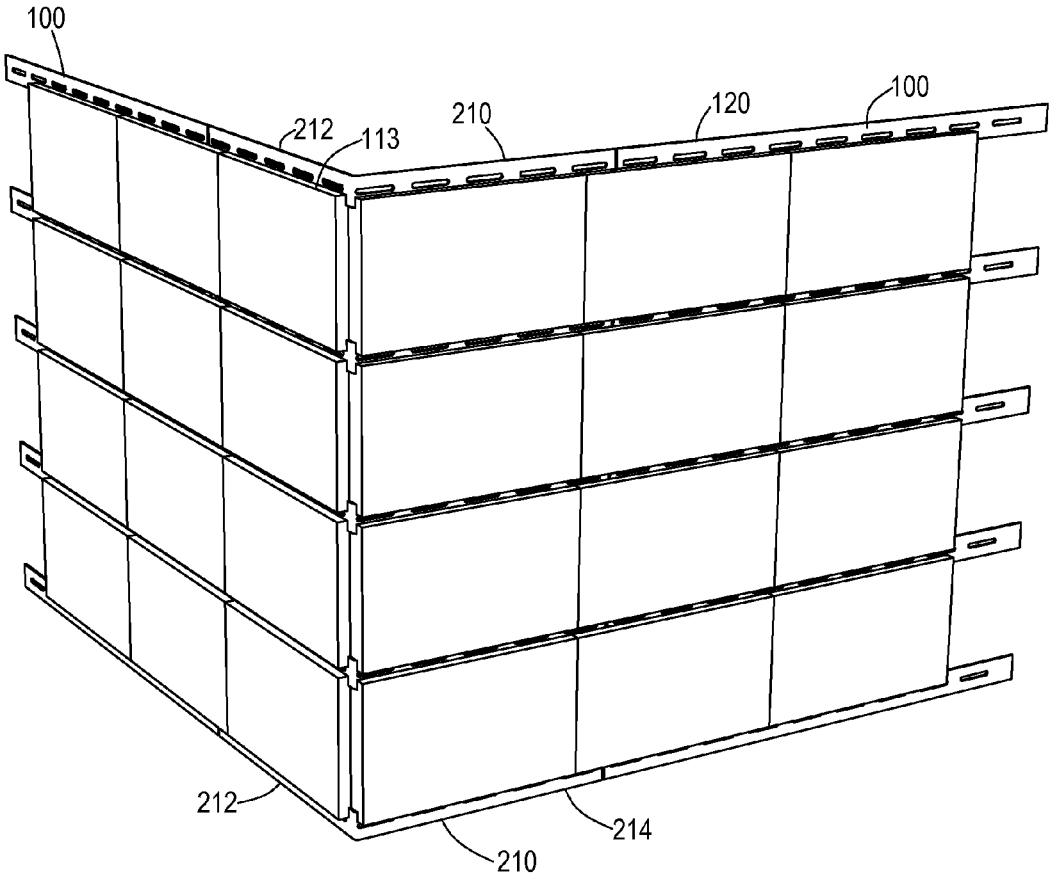
FIG. 2I illustrates a high level view of a pair of perpendicularly positioned enclosure members of FIGS. 2A-2B, according to certain embodiments.

FIG. 2A illustrates a high level perspective view of a portion of an enclosure member 100 comprising a plurality of slabs 110 and a plurality of strips 120. FIG. 2B illustrates a full high level perspective view of enclosure member 100. FIG. 2C illustrates a high level perspective view of a slab 110. FIG. 2D illustrates a high level perspective view of a strip 120. FIG. 2E illustrates a high level perspective view of a temporary hardenable material construction apparatus 200. FIG. 2F illustrates a high level perspective view of temporary hardenable material construction apparatus 200 further comprising an insulation layer. FIG. 2G illustrates a high level perspective view of temporary hardenable material construction apparatus 200 without freestandable support frames for clarity. FIG. 2H illustrates a high level perspective view of an L-shaped corner member 210. FIG. 2I illustrates a high level perspective view of a pair of perpendicularly positioned enclosure members 100 secured to each other with a plurality of L-shaped corner members 210. FIGS. 2A-2I will be described together.

Each slab 110 exhibits: a first face 111; a second face 112 opposing first face 111; a first side 113 extending from first face 111 to second face 112; a second side 114 extending from first face 111 to second face 112 and opposing first side 113; a third side 115 extending from first face 111 to second face 112 and from first side 113 to second side 114; and a fourth side 116 extending from first face 111 to second face 112 and from first side 113 to second side 114, fourth side 116 opposing third side 115. First side 113 and second side 114 of each slab 110 exhibits a slit 130 extending therealong from third side 115 to fourth side 116. Slits 130 are each configured to receive a respective strip 120. Particularly, the width of slit 130 is configured to be greater than, or equal to, the thickness of each strip 120.

As illustrated in FIGS. 2A-2B, enclosure member 100 is formed of a plurality of columns of slabs 110. Particularly, each column of slabs 110 comprises a plurality of slabs 110 on top of each other such that first side 113 of each slab 110 faces second side 114 of an adjacent slab 110. Columns of slabs 110 are positioned next to each other to form rows of slabs 110 such that third side 115 of each slab 110 faces fourth side 116 of an adjacent slab 110. Each strip 120 is disposed within slit 130 of first side 113 of a respective slab 110 and within slit 130 of second side 114 of the adjacent slab 110 which faces the respective first side 113. In one embodiment, the length of each strip 120 is greater than the length of each slit 130 such that each strip 120 is disposed within slits 130 of slabs 110 from more than one column. In another embodiment, the length of each strip 120 is not greater than the length of each slit 130, however strips 120 are disposed within slits 130 such that each strip 120 is disposed within slits 130 of slabs 110 from more than one column. As illustrated in FIG. 2D, each strip 120 exhibits one or more holes.

Temporary hardenable material construction apparatus 200 of FIG. 2E is in all respects similar to temporary hardenable material construction apparatus 10, with the exception that enclosure member 50 is replaced with enclosure member 100. As illustrated in FIG. 2G, where freestandable members 20, 30 are not shown for simplicity, extension members 40 extend through holes 140 of strips 120. In one embodiment, after insertion through holes 140, extension members 40 are each welded to the respective strip 120. In another embodiment, extension members 40 each comprise a plurality of grooves and a nut is threaded onto each extension member 40 on one or both sides of the respective strip 120. Securing enclosure member 100 with nuts, or by welding, keeps enclosure member 100 from sliding along extension members 40.

In one embodiment, the depth of each slit 130 is configured to be less than half the width of each strip 120 such that when strip 120 is disposed within slits 130 of the respective adjacent slabs 110, slabs 110 do not meet and there is a space 135 between first side 113 of a first of the adjacent slabs 110 and second side 114 of the second of the adjacent slabs 110, the respective extension member 40 extending through the space 135 between the respective first side 113 and second side 114.

In another embodiment, when forming enclosure member 100, a first slab 110 is positioned and a strip 120 is disposed within slit 130 of first side 113 thereof. At least two extension members 40 are then inserted through respective holes 140 of the disposed strip 120. An additional slab 110 is then position on top of the first slab 110 such that the disposed strip 120 is additionally disposed within second side 114 of the additional slab 110, the separation of the adjacent slabs 110 being maintained by the inserted extension members 40.

In order to add a window or door within the wall, a predetermined number of slabs 110 are left out of enclosure member 100. In place of the left out slabs 110, a frame is inserted which extends through space 70 thereby not allowing hardenable material to enter the space surrounded by the inserted frame.

After hardenable material is poured into space 70, freestandable support frames 20, 30 are removed and first and second ends 42, 44 of each extension member 40 is sawed off. In one embodiment, the space between each adjacent pair of slabs 110 is filled with a filling material.

In one embodiment, as illustrated in FIG. 2F, an insulation layer 150 is further provided, juxtaposed with second faces 112 of slabs 110, as will be described below in relation to temporary hardenable material construction apparatus 300.

As illustrated in FIG. 2I, a pair of enclosure members 100 are illustrated being positioned perpendicularly to each other. A plurality of L-shaped corner members 210, illustrated in FIG. 2H, are arranged to connect the pair of enclosure members 100. Particularly, each L-shaped corner member 210 exhibits a first half 212 and a second half 214, second half 214 being perpendicular to first half 212. First half 212 of each L-shaped corner member 210 is disposed within respective slits 130 of a first of the pair of perpendicularly positioned enclosure members 100 and second half 214 of each L-shaped corner member 210 is disposed within respective slits 130 of the second of the pair of perpendicularly positioned enclosure members 100. Preferably, L-shaped corner members 210 are each formed as a single piece, i.e. not two separate pieces which are welded or screwed together. Therefore, when hardenable material is poured into space 70 defined by both enclosure members 100, L-shaped corner members 210 secure enclosure members 100 to each other so as not separate responsive to the pressure applied by the poured hardenable material.

Figure 3A:
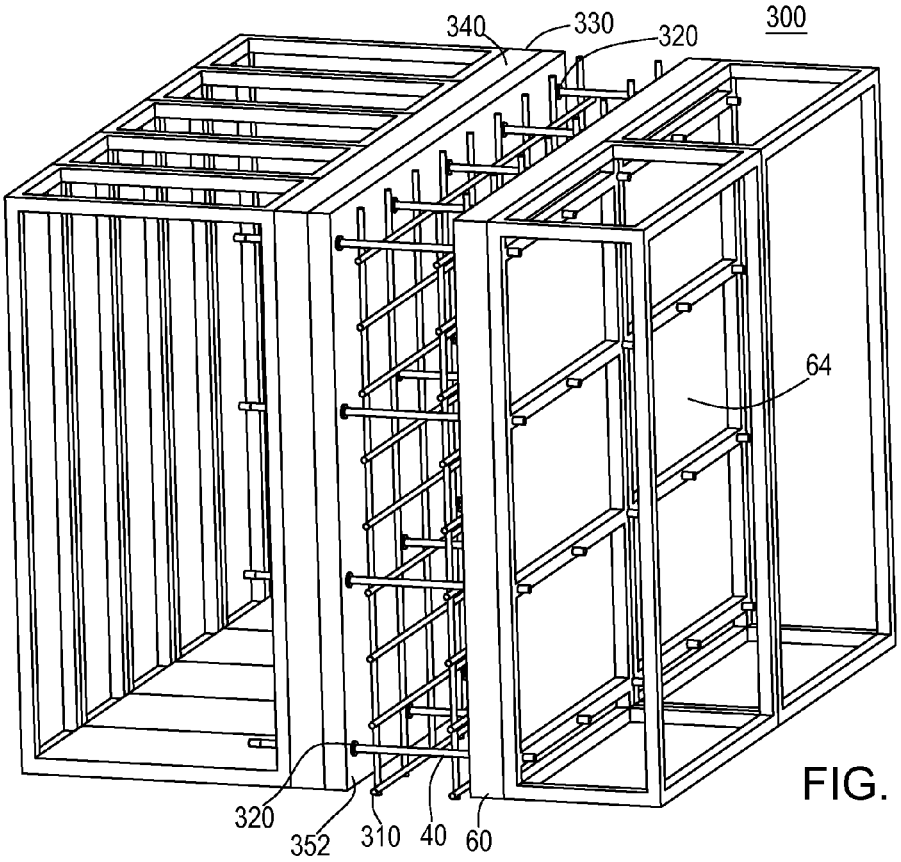
FIGS. 3A-3B illustrate various high level views of a temporary hardenable material construction apparatus further comprising a pair of grid assemblies and a double layer enclosure member, according to certain embodiments.
Figure 3B:
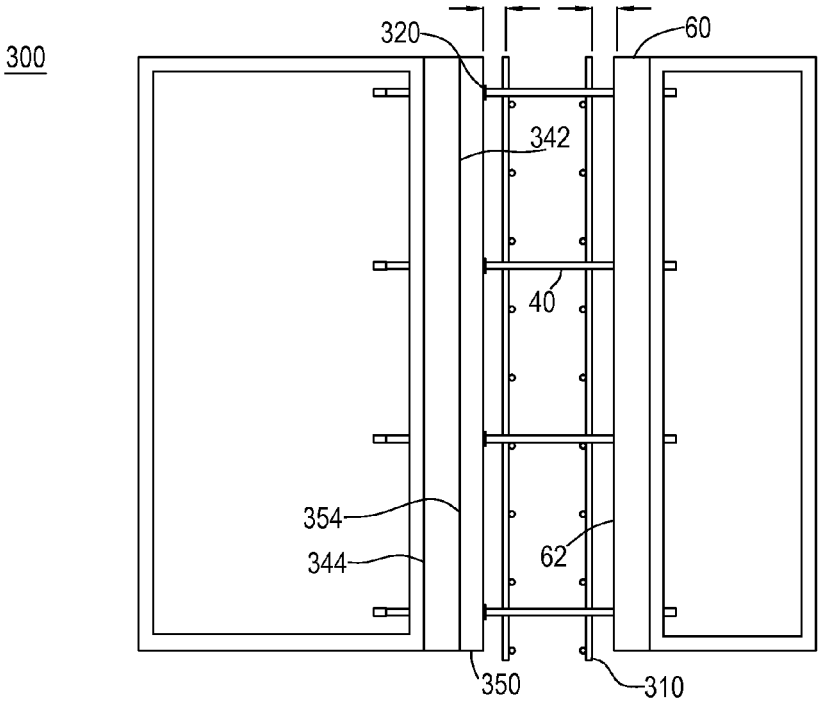

FIG. 3A illustrates a high level perspective view of a temporary hardenable material construction apparatus 300; and FIG. 3B illustrates a high level side view of temporary hardenable material construction apparatus 300, FIGS. 3A-3B being described together. Temporary hardenable material construction apparatus 300 is in all respects similar to temporary hardenable material construction apparatus 10, further comprising a pair of grid assemblies 310 and a plurality of securing members 320. Additionally, enclosure member 50 is replaced with an enclosure member 330. Enclosure member 330 comprises: an outer layer 340 exhibiting an inner face 342 and an outer face 344 opposing inner face 342; and an insulation layer 350 exhibiting an inner face 352 and an outer face 354.

In one embodiment, as described above in relation to temporary hardenable material construction apparatus 200, outer layer 340 comprises a plurality of slitted slabs coupled together with strips disposed within the slits of the slabs. In one embodiment, insulation layer 350 comprises a panel of insulating material, such as polystyrene. In another embodiment, insulation layer 350 comprises a hardenable insulating material which is sprayed onto inner face 342 of outer layer 340, thereby forming a hardened insulation layer over inner face 342.

Inner face 342 of outer layer 340 faces outer face 354 of insulation layer 350. Inner face 352 of insulation layer 350 faces inner face 62 of enclosure member 60, space 70 being defined by inner face 62 of enclosure member 60 and inner face 352 of insulation layer 350.

Each grid assembly 310 is constructed of a grid of horizontal and vertical bars, preferably steel bars. Each grid assembly 310 is separated from a respective one of enclosure member 330 and enclosure member 60 by at least a predetermined distance. Preferably, the predetermined distance is 1.5 centimeters. In one embodiment, grid assemblies 310 are welded to at least some of extension members 40 at the predetermined distance from the respective one of enclosure members 330, 60. In another embodiment, a pair of separation members are attached to each extension member 40, optionally screwed thereon, the separation members arranged to keep grid assemblies 310 from becoming too close to the respective enclosure member 330, 60. In the event that grid assemblies 310 become too close to the respective enclosure members 330, 60, poured hardenable material may not separate between them and a chemical reaction will initiate between the metal of the respective grid assembly 310 and the respective enclosure member 330, 60.

Each securing member 320 is attached to a respective one of extension members 40, preferably screwed thereon, and disposed on inner face 352 of insulation layer 350. Securing members 320 are arranged to press insulation layer 350 against outer layer 340 to secure insulation layer 350 to outer layer 340 to further maintain the predetermined distance between insulation layer 350 and the adjacent grid assembly 310. In one embodiment (not shown), an additional securing member is attached to each extension member 40 and disposed on inner face 62 of enclosure member 60 to secure enclosure member 60 to freestandable support frames 30 while maintaining smooth contact therewith. Particularly, in the event that a nut is screwed onto an extension member 40 and pressed against outer wall 64 of enclosure member 60, the additional securing member is arranged to secure enclosure member 60 so as not to accidentally be pushed or distorted from pressing the nut too much into outer wall 64.

In one embodiment, outer face 354 of insulation layer 350 is in direct contact with inner face 342 of outer layer 340, i.e. there is no plaster between insulation layer 350 and outer layer 340. As a result, when condensation trapped between insulation layer 350 and outer layer 340 turns into droplets during the night, the droplets will slide down inner face 342 of outer layer 340 and outer face 354 of insulation layer 350 until reaching the ground. Advantageously, the condensation doesn't remain between insulation layer 350 and outer layer 340 and thus will not expand during the day and cause damage and deformations of outer layer 340.

Figure 4:
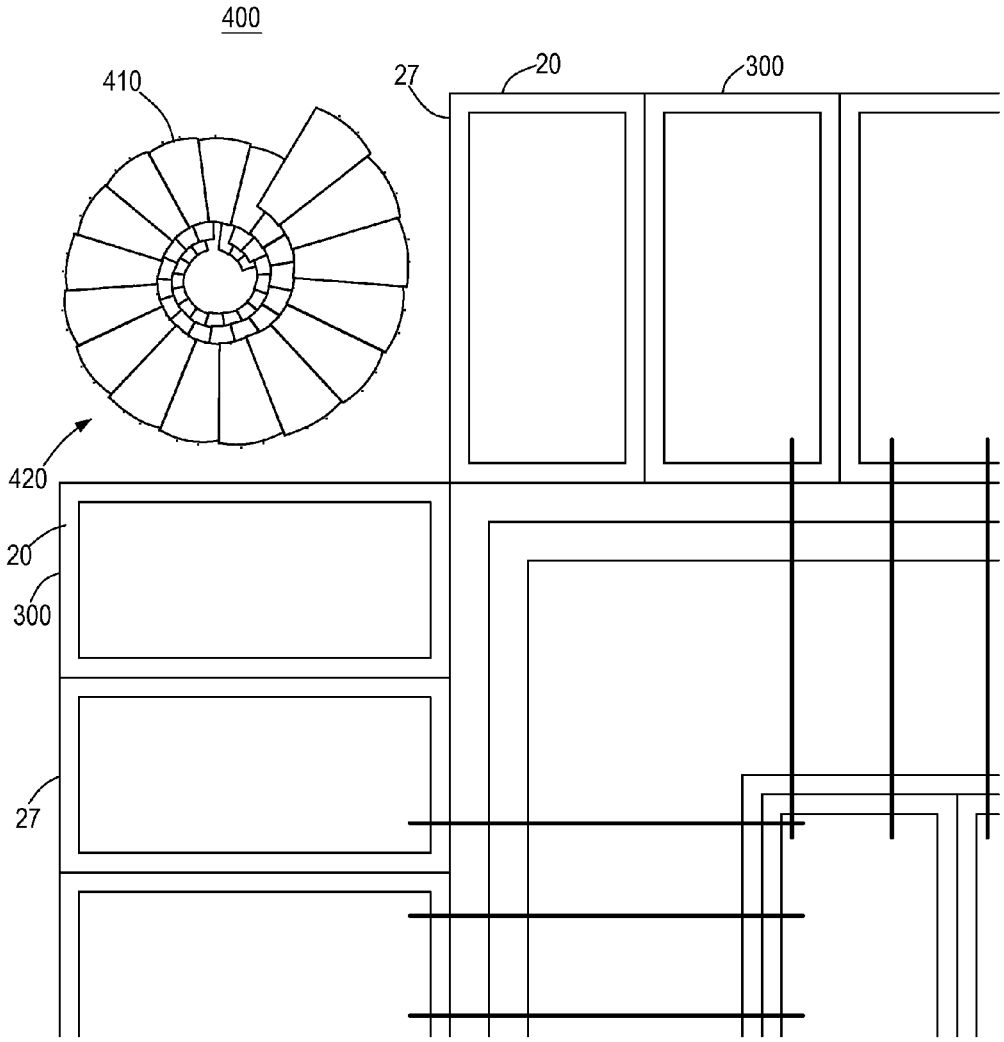
FIG. 4 illustrates a high level schematic top view of a temporary hardenable material construction apparatus comprising a spiral staircase, according to certain embodiments.

FIG. 4 illustrates a high level schematic diagram of a high level top view of a portion of a temporary hardenable material construction apparatus 400. Temporary hardenable material construction apparatus 400 comprises a pair of temporary hardenable material construction apparatuses 300 positioned perpendicularly to each other. Temporary hardenable material construction apparatus 400 further comprises a spiral staircase 410 at a corner 420 where perpendicularly positioned temporary hardenable material construction apparatuses 300 meet. As illustrated, a space exists between the ultimate freestandable support frame 20 of a first of the pair of temporary hardenable material construction apparatuses 300 and the ultimate freestandable support frame 20 of the second of the pair of temporary hardenable material construction apparatuses 300 at corner 420, spiral staircase 410 positioned within the empty space of corner 420. Spiral staircase 410 is arranged to rise to the height of top portions 27 of freestandable support frames 20 so that a second level of freestandable support frames 20, which are disposed on top of the first level of freestandable support frames 20, is easily accessible. If additional levels of freestandable support frames 20 are provided, as will be described further below, spiral staircase 410 is arranged to rise to the highest level of freestandable support frames 20. For simplicity, only a portion of each temporary hardenable material construction apparatus 300 is illustrated. Additionally, for simplicity, grid assemblies 310 and securing members 320 are not illustrated.

Figure 5A:
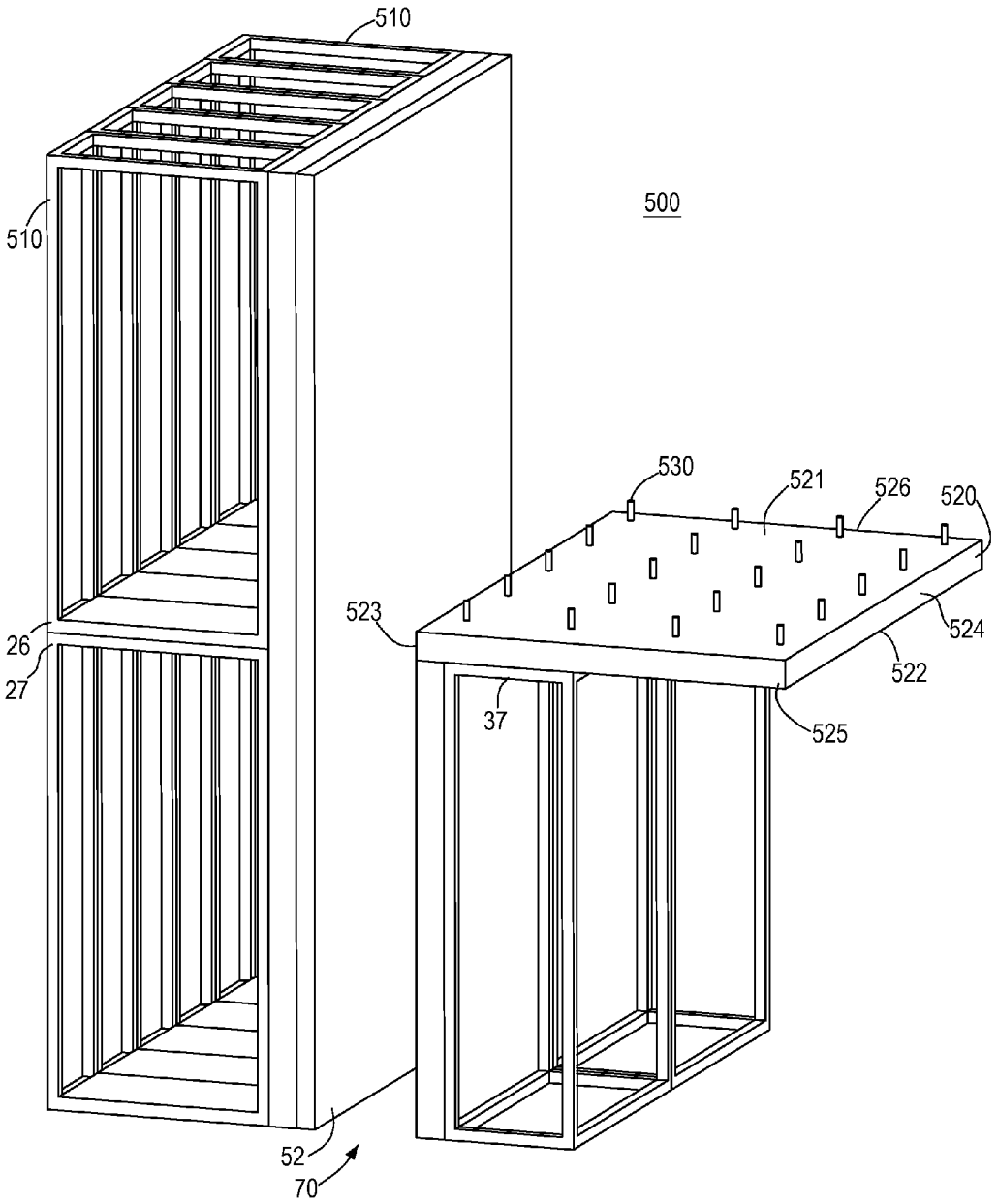
FIGS. 5A-5E illustrate various high level views of a temporary hardenable material construction apparatus comprising a ceiling panel, according to certain embodiments.
Figure 5B:
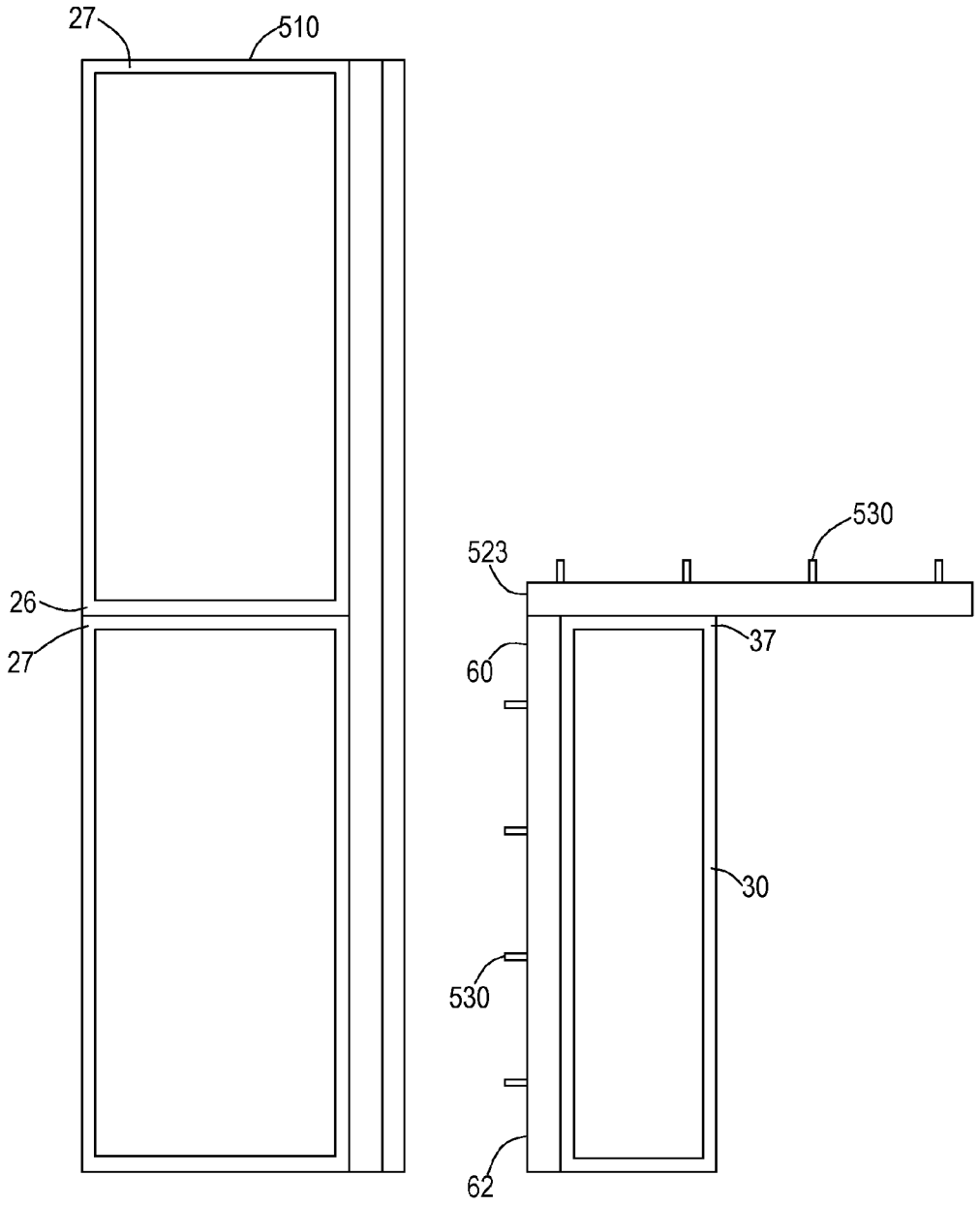
Figure 5C:
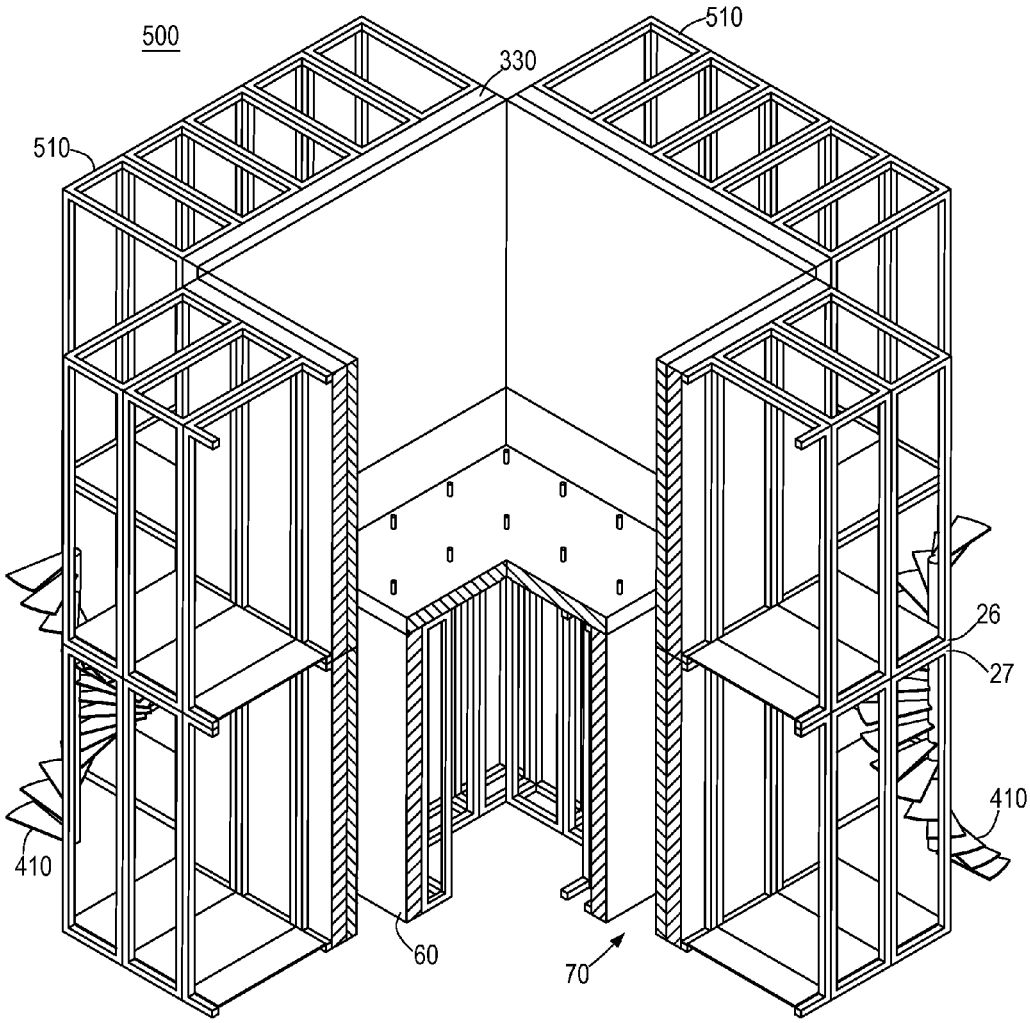
Figure 5D:
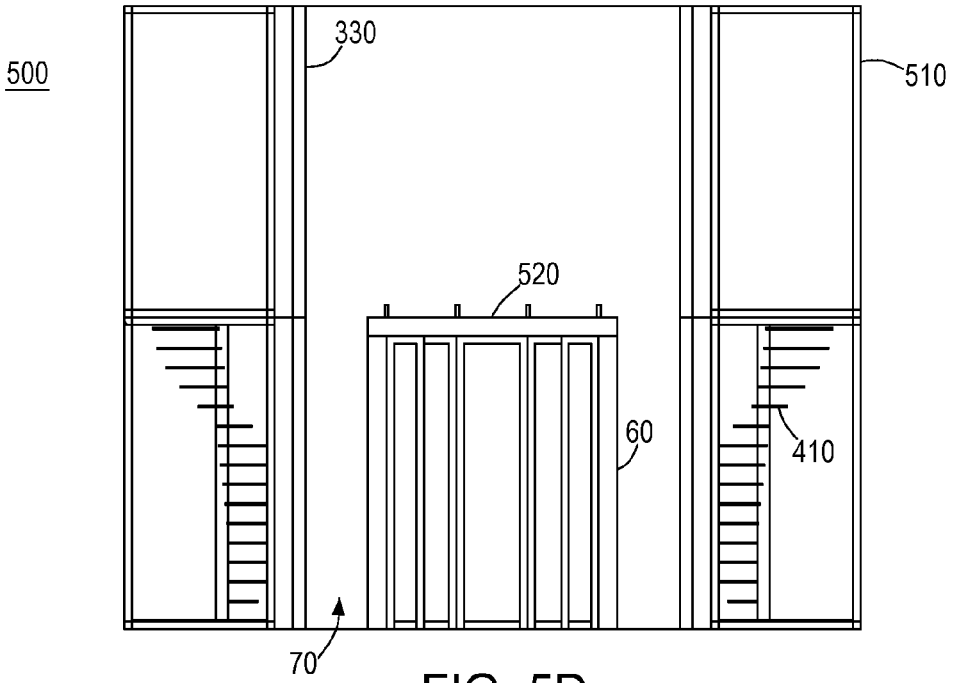

FIG. 5A illustrates a high level perspective view of a portion of a temporary hardenable material construction apparatus 500. FIG. 5B illustrates a high level side view of the portion of temporary hardenable material construction apparatus 500 of FIG. 5A. FIG. 5C illustrates a high level perspective view of temporary hardenable material construction apparatus 500. FIG. 5D illustrates a high level side view of temporary hardenable material construction apparatus 500.

Figure 5E:
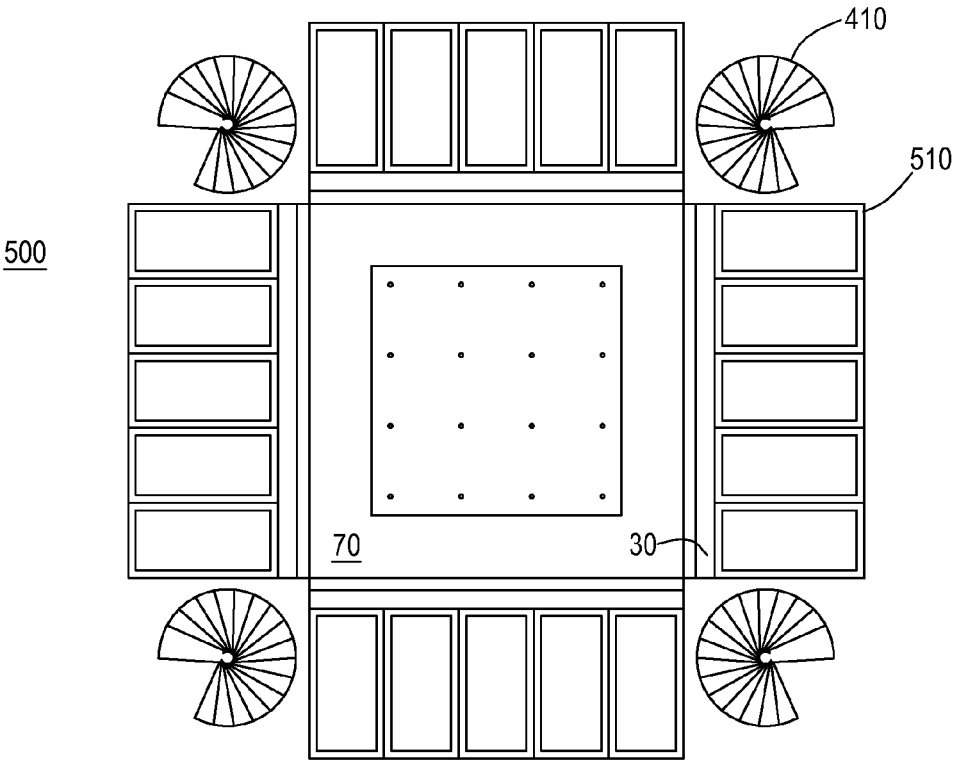
Figure 5F:
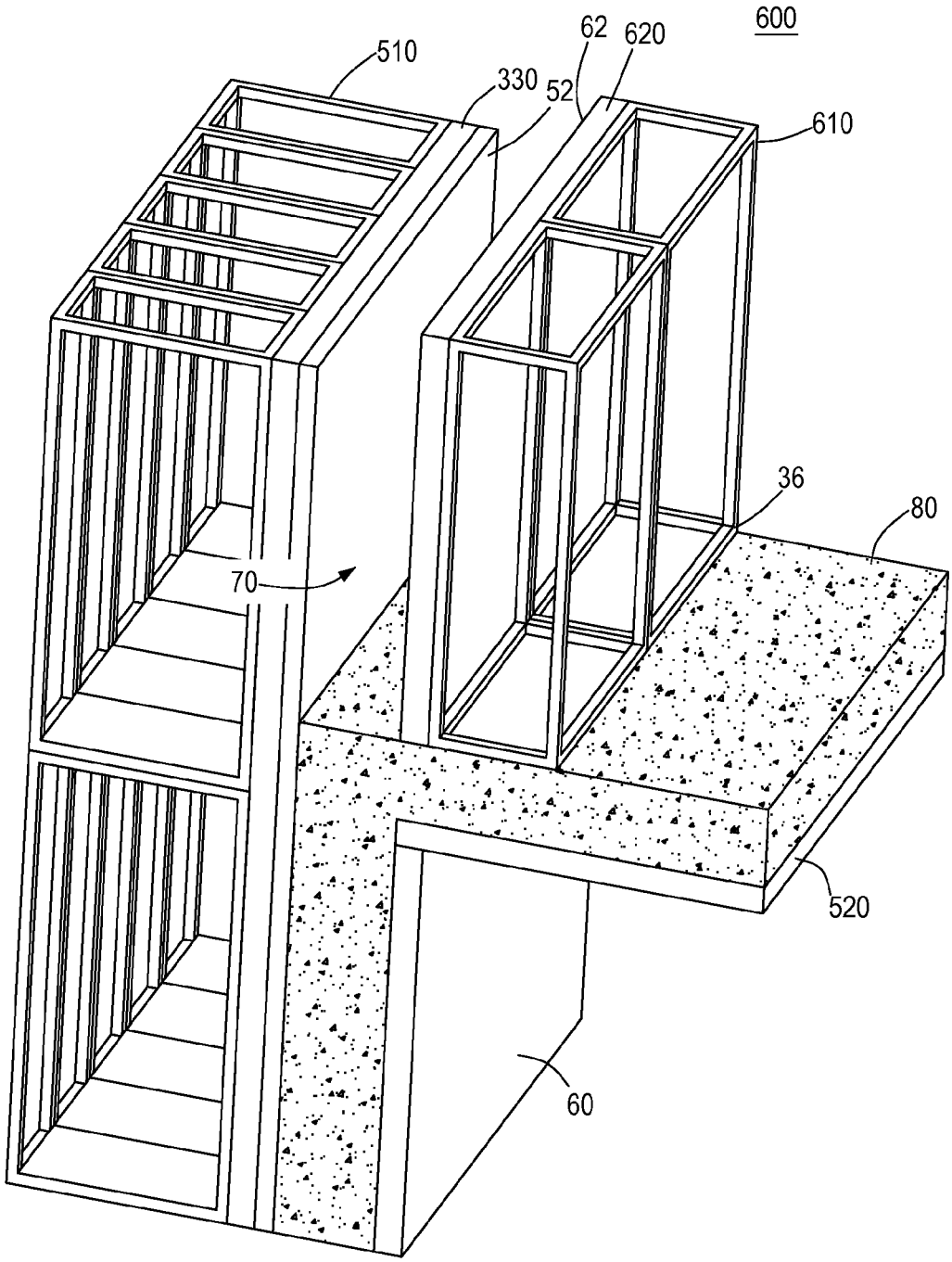
FIG. 5F illustrates a high level perspective view of a temporary hardenable material construction apparatus in an advanced stage of construction, according to certain embodiments.

FIG. 5E illustrates a high level top view of temporary hardenable material construction apparatus 500. FIG. 5F illustrates a high level perspective view of a temporary hardenable material construction apparatus 600. FIGS. 5A-5F are described together. Temporary hardenable material construction apparatus 500 is in all respects similar to temporary hardenable material construction apparatus 300 with the addition of: a plurality of freestandable support frames 510; a ceiling panel 520 exhibiting a first face 521, a second face 522 opposing first face 521, a first side 523 extending from first face 521 to second face 522, a second side 524 opposing first side 523 and extending from first face 521 to second face 522, a third side 525 perpendicular to first side 523 and extending from first face 521 to second face 522, and a fourth side 526 opposing third side 525 and extending from first face 521 to second face 522; and a plurality of hardenable material securing members 530. For clarity, extension members 40, grid assemblies 310 and securing members 320 are not shown. In one embodiment, ceiling panel 520 comprises a drywall panel. Additionally, as illustrated in FIGS. 5C-5D, temporary hardenable material construction apparatus 500 comprises four enclosure members 330 and four enclosure members 60, space 70 being defined between inner faces 52 of enclosure members 330 and inner faces 62 of enclosure members 60.

Freestandable support frames 510 are in all respects similar to freestandable support frames 20 and base portion 26 of each freestandable support frame 510 is positioned on top of top portion 27 of a respective freestandable support frame 20 such that freestandable support frames 510 are supported by freestandable support frames 20. Enclosure member 330 extends from base portions 26 of freestandable support frames 20 to top portions 27 of freestandable support frames 510.

Second face 522 of ceiling panel 520 is disposed on top portions 37 of freestandable support frames 30 and on enclosure member 60. Particularly, first side 523 of ceiling panel 520 meets the plane defined by inner face 62 of enclosure member 60, ceiling panel 520 extending away from freestandable support frames 30. As illustrated in FIGS. 5C and 5D, ceiling panel 520 is disposed on four rows of freestandable support frames 30. Each of a first set of hardenable material securing members 530 extends vertically from within ceiling panel 520 to a point above first face 521. In one embodiment, each hardenable material support member 530 extends about 12 centimeters above first face 521. In another embodiment, each hardenable material support member 530 is 6-8 millimeters thick. In one embodiment, hardenable material securing members 530 are spaced apart from each other at distances of about 60 centimeters. In another embodiment, each hardenable material support member 530 comprises a screw. Similarly, each of a second set of hardenable material securing members 530 extends horizontally from within enclosure member 60 to a point within space 70, displaced from inner face 62 of enclosure member 60. In one embodiment, wooden beams, and optionally an additional wooden panel, are disposed between ceiling panel 520 and top portions 37 of freestandable support frames 30.

As described above in relation to temporary hardenable material construction apparatus 400, a spiral staircase 410 is positioned at each corner of the rows of freestandable support frames 20 such that freestandable support frames 510 are easily accessible.

Hardenable material 80 is poured onto ceiling panel 520. Hardenable material 80, which as described above is a fluid material, such as concrete, spills over first, second, third and fourth sides 523, 524, 525, 526 of ceiling panel 520 into space 70 formed between the four second enclosure members 60 and four enclosure members 330. As a result, four walls and a ceiling are formed as a single block of hardenable material 80, which gradually hardens. Hardenable material securing members 530 are arranged to secure ceiling panel 520 and each of enclosure members 60 to hardenable material 80 after hardening. Advantageously, in the embodiment where ceiling panel 520 and enclosure members 60 each comprise a drywall panel, the drywall panels are directly attached to the hardened hardenable material, without the use of plaster.

After pouring hardenable material 80, a second floor can be built, as illustrated in temporary hardenable material construction apparatus 600 of FIG. 5F, which represents temporary hardenable material construction apparatus 500 after hardenable material 80 is poured. Particularly, temporary hardenable material construction apparatus 600 is in all respects similar to temporary hardenable material construction apparatus 500, with the exception that freestandable support frames 30 are replaced with a plurality of freestandable support frames 610. Additionally, an enclosure member 620 is provided. Freestandable support frames 610 are in all respects similar to freestandable support frames 30, with the exception that base portions 36 of freestandable support frames 610 are positioned on top of hardenable material 80, over ceiling panel 520 and over the location of the previously positioned freestandable support frames 30. Enclosure member 620 is in all respects similar to enclosure member 60, with the exception that enclosure member 620 is positioned on top of hardenable material 80, over ceiling panel 520 and over enclosure member 60. As described above in relation to freestandable support frames 30, first face 32 of each freestandable support frame 30 is juxtaposed with outer face 64 of enclosure member 620. As described above in relation to enclosure members 50 and 60, a space 70 is defined between inner face 52 of enclosure member 330 and inner face 62 of enclosure member 620. A ceiling panel (not shown) can be positioned on top of freestandable support frames 610 and hardenable material 80 can be poured thereon, as described above in relation to temporary hardenable material construction apparatus 500. As described above, extension members 40 extend through enclosure member 330 and enclosure member 620 and are secured to freestandable support frames 510 and freestandable support frames 610.

Figure 6A:
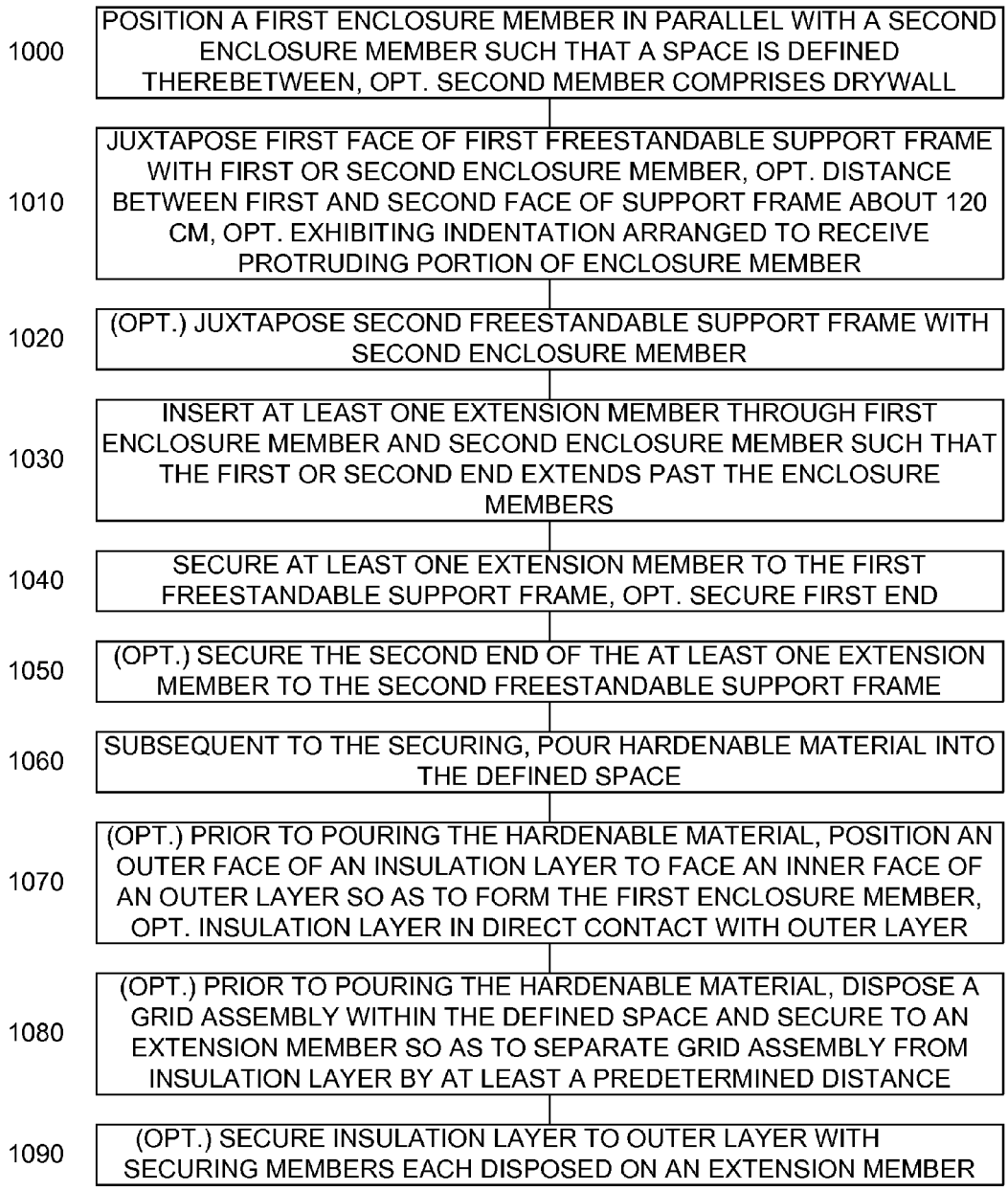
FIGS. 6A-6C illustrate various a high level flow charts of a hardenable material construction method, according to certain embodiments.

FIG. 6A illustrates a high level flow chart of a hardenable material construction method. In stage 1000, a first enclosure member is positioned in parallel with a second enclosure member such that a space is defined between an inner face of the first enclosure member and an inner face of the second enclosure member. Optionally, the second enclosure member is formed of a drywall panel, optionally sealed with a liquid repelling material.

In stage 1010, a first freestandable support frame is juxtaposed with an outer face of the first enclosure member of stage 1000 or the outer face of the second enclosure member of stage 1000. The outer face of the first enclosure member opposes the inner face of the first enclosure member. The outer face of the second enclosure member opposes the inner face of the second enclosure member. First freestandable support frame extends from a first face to a second face, the first face thereof juxtaposed with the outer face of the first enclosure member. Optionally, the distance between the first face and the second face of the first freestandable support frame is about 120 centimeters. Optionally, a plurality of first freestandable support frames are each juxtaposed with the outer face of the first enclosure member, or the outer face the second enclosure member, the plurality of first freestandable support frames arranged in a row. Optionally, the first freestandable support frame exhibits an indentation in the first face thereof, the indentation arranged to receive a protruding portion of the first enclosure member of stage 1000.

In optional stage 1020, a second freestandable support frame is juxtaposed with an outer face of the second enclosure member of stage 1000, the outer face of the second enclosure member opposing the inner face of the second enclosure member. In such an embodiment, the first freestandable support frame of stage 1010 is juxtaposed with the outer face of the first enclosure member of stage 1000. Optionally, a plurality of second freestandable support frames are each juxtaposed with the outer face of the second enclosure member, the plurality of second freestandable support frames arranged in a row.

In stage 1030, at least one extension member is inserted through the first enclosure member and the second enclosure member such that a first end of the at least one extension member extends past the outer face of the first enclosure member of stage 1000 or a second end of the at least one extension member, opposing the first end thereof, extends past the outer face of the second enclosure member of stage 1000.

In stage 1040, the at least one extension member of stage 1030, optionally the first end thereof, is secured to the first freestandable support frame of stage 1010. Optionally, a plurality of extension members are each secured to a respective one of a plurality of first freestandable support frames. In optional stage 1050, the second end of the at least one extension member is secured to the second freestandable support frame of optional stage 1020. Optionally, a plurality of extension members are each secured to a respective one of a plurality of second freestandable support frames.

In stage 1060, subsequent to the securing the at least one extension member to the first and second freestandable support frame of stages 1040-1050, hardenable material is poured into the space defined between the first enclosure member and the second enclosure member of stage 1000.

In optional stage 1070, prior to the pouring hardenable material of stage 1060, an outer face of an insulation layer is positioned to face an inner face of an outer layer so as to form the first enclosure member of stage 1000. The outer layer exhibits an outer face opposing the inner face thereof, an outer face of the first enclosure member of stage 1000, opposing the inner face thereof, comprising the outer face of the outer layer. Additionally, the insulation layer exhibits an inner face opposing the outer face thereof, the inner face of the first enclosure member of stage 1000 comprising the inner face of the insulation layer. Optionally, the outer face of the insulation layer is positioned to be in direct contact with the inner face of the outer layer. Particularly, no plaster is disposed between the insulation layer and the outer layer.

In optional stage 1080, a grid assembly is disposed within the defined space of stage 1000. Additionally, the grid assembly is secured to one of a plurality of the extension members of stage 1030 so as to separate the grid assembly from the insulation layer of optional stage 1070 by at least a predetermined distance. In optional stage 1090, the insulation layer is secured to the outer layer with a plurality of securing members, each of the plurality of securing members disposed on a respective one of a plurality of the extension members of stage 1030.

Figure 6B:
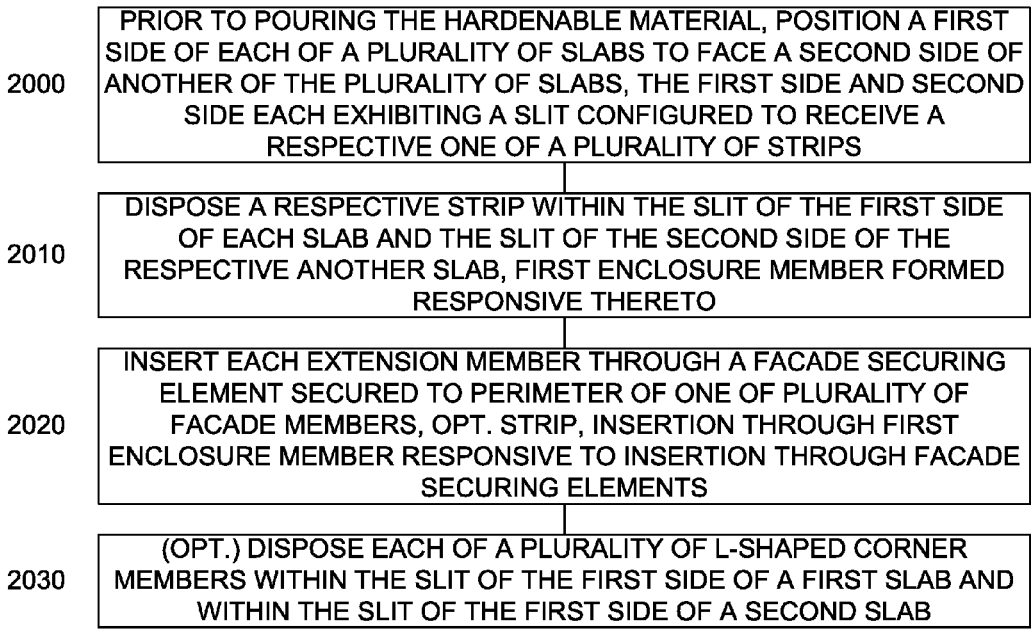

FIG. 6B illustrates a high level flow chart of optional stages of forming the first enclosure of stage 1000 of FIG. 6A. In stage 2000, a first side of each of a plurality of slabs is positioned to face a second side of another of the plurality of slabs, the second side of each of the plurality of slabs opposing the first side thereof. The first side and second side of each of the plurality of slabs exhibit a slit configured to receive a respective one of a plurality of strips. In stage 2010, a respective one of the plurality of strips of stage 2000 is disposed within the slit of the first side of each of the plurality of slabs of stage 2000 and the slit of the second side of the respective another slab.

In stage 2020, each of a plurality of the extension members of stage 1030 is inserted through a respective one of a plurality of facade securing elements, the facade securing elements each secured to one of a plurality of facade members. Optionally, each facade member comprises a slab of stage 2000 and each facade securing element comprises a strip of stage 2010. Optionally, the insertion through the first enclosure member of stage 1030 is responsive to the insertion through the plurality of facade securing elements.

In optional stage 2030, each of a plurality of L-shaped corner members, each exhibiting a first end and a second end perpendicular to the first end, is disposed within the slit of the first side of a first of the plurality of slabs of stage 2000 and within the slit of the first side of a second of the plurality of slabs.

Figure 6C:
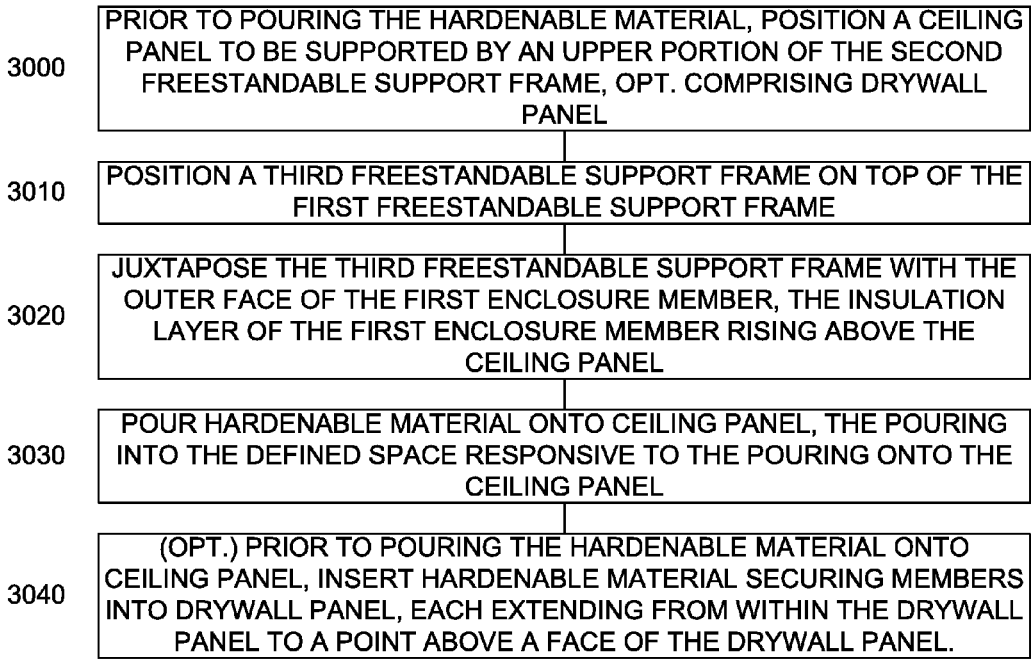

FIG. 6C illustrates a high level flow chart of further optional stages of the hardenable material construction method of stages 1000-1090. In stage 3000, prior to the pouring hardenable material of stage 1060, a ceiling panel is positioned to be supported by an upper portion of the second freestandable support frame of stage 1020. In stage 3010, a third freestandable support frame is positioned on top of the first freestandable support frame. In stage 3020, the third freestandable support frame of stage 3010 is juxtaposed with the outer face of the first enclosure member, the insulation layer of the first enclosure member of optional stage 1070 rising above the positioned ceiling panel. In stage 3030, hardenable material is poured onto the ceiling panel, the pouring hardenable material into the space defined between the first enclosure member and the second enclosure member of stage 1060 responsive to the pouring hardenable material onto the positioned ceiling panel. The hardenable material spills from the ceiling panel into the defined space such that a single block of hardenable material is formed as a ceiling and walls.

In optional stage 3040, the positioned ceiling panel comprises a drywall panel with a plurality of hardenable material securing members inserted into the drywall panel such that each of the plurality of hardenable material securing members extend from within the drywall panel to a point above a face of the drywall panel.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

The terms "include", "comprise" and "have" and their conjugates as used herein mean "including but not necessarily limited to".

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A temporary hardenable material construction apparatus comprising:

a first freestandable support frame having a first face and a second face opposing said first face, the distance between said first face and said second face being at least 60 centimeters;

at least one extension member, said at least one extension member exhibiting a first end and a second end opposing said first end;

at least one first enclosure member exhibiting an inner face and an outer face opposing said inner face; and at least one second enclosure member exhibiting an inner face and an outer face opposing said inner face, said at least one second enclosure member positioned in parallel with said at least one first enclosure member such that a space is defined between said inner face of said at least one first enclosure member and said inner face of said at least one second enclosure member, wherein said first face of said first freestandable support frame is juxtaposed with said outer face of said at least one first enclosure member or said outer face of said second enclosure member such that said first face of said first freestandable support frame is substantially completely covered by said outer face of said at least one first enclosure member or said outer face of said second enclosure member, wherein said at least one extension member extends through said first enclosure member and said second enclosure member such that said first end of said at least one extension member extends past said outer face of said first enclosure member or said second end of said at least one extension member extends past said outer face of said second enclosure member, and wherein said at least one extension member is secured to said first freestandable support frame.

2. The apparatus of claim 1, further comprising a second freestandable support frame having a first face and a second face opposing said first face, the distance between said first face and said second face being at least 60 centimeters, said first face of said first freestandable support frame juxtaposed with said outer face of said at least one first enclosure member and said first face of said second freestandable support frame juxtaposed with said outer face of said second enclosure member such that said first face of said first freestandable support frame is substantially completely covered by said outer face of said at least one first enclosure member and said first face of said second freestandable support frame is substantially completely covered by said outer face of said second enclosure member, wherein said first end of said at least one extension member is secured to said first freestandable support frame and said second end of said at least one extension member is secured to said second freestandable support frame.

3. The apparatus of claim 1, wherein said at least one first enclosure member comprises:

a plurality of strips; and a plurality of slabs, each of said plurality of slabs exhibiting a first face, a second face opposing said first face, a first side extending from said first face to said second face and a second side opposing said first side, each of said first side and said second side exhibiting a slit thereal-ong, said slit configured to receive a respective one of said plurality of strips, wherein said first side of each of said plurality of slabs faces said second side of another of said plurality of slabs, a respective one of said plurality of strips disposed within said slit of said first side of said respective slab and within said slit of said second side of said another respective slab, and wherein said at least one extension member comprises a plurality of extension members, each of said plurality of extension members extending through a respective one of said plurality of strips.

4. The apparatus of claim 3, further comprising a plurality of L-shaped corner members, each of said L-shaped corner members exhibiting a first end and a second end perpendicular to said first end, said slit of each of said plurality of slabs further configured to receive one of a first end and a second end of a respective one of said plurality of L-shaped corner members, wherein said at least one first enclosure member comprises a pair of first enclosure members positioned perpendicular to each other, said first end of each of said plurality of L-shaped corner members disposed within said slit of said first side of a respective one of said plurality of slabs of a first of said pair of first enclosure members and said second end of each of said plurality of L-shaped corner members disposed within said slit of said first side of a respective one of said plurality of slabs of a second of said pair of first enclosure members.

5. The apparatus of claim 1, wherein said first enclosure member comprises:

a plurality of facade members; and a plurality of facade securing elements, each of said plurality of facade securing elements secured to a perimeter of a respective one of said plurality of facade members, wherein said at least one extension member comprises a plurality of extension members, each of said plurality of extension members extending through a respective one of said plurality of facade securing elements.

6. The apparatus of claim 1, wherein said first enclosure member comprises:

an outer layer exhibiting an inner face and an outer face opposing said inner face, said outer face of said first enclosure member comprising said outer face of said outer layer; and an insulation layer exhibiting an inner face and an outer face opposing said inner face, said inner face of said insulation layer facing said inner face of said second enclosure member, said outer face of said insulation layer facing said inner face of said outer layer.

7. The apparatus of claim 6, wherein said outer face of said insulation layer is in direct contact with said inner face of said outer layer.

8. The apparatus of claim 7, further comprising:

a grid assembly disposed within said defined space;

at least one securing member, each of said at least one securing members disposed on a respective one of said at least one extension member and juxtaposed with said insulation layer to secure said insulation layer to said outer layer; and wherein said grid assembly is secured to said at least one extension member so as to separate said grid assembly from said insulation layer by at least a predetermined distance.

9. The apparatus of claim 6, further comprising:

a second freestandable support frame, said first face of said first freestandable support frame juxtaposed with said outer face of said at least one first enclosure member and said second freestandable support frame juxtaposed with said outer face of said second enclosure member;

a ceiling panel supported by an upper portion of said second freestandable support frame; and a third freestandable support frame, wherein said third freestandable support frame is positioned on top of said first freestandable support frame, said third freestandable support frame juxtaposed with said outer face of said first enclosure member, said insulation layer of said first enclosure member rising above said ceiling panel.

10. The apparatus of claim 9, wherein said ceiling panel comprises:

a drywall panel; and a plurality of hardenable material securing members, each of said plurality of hardenable material securing members extending from within said drywall panel to a point above a face of said drywall panel.

11. The apparatus of claim 9, further comprising a spiral staircase, wherein said first freestandable support frame exhibits a base portion and top portion opposing said base portion, said first freestandable support frame extending generally vertically from said base portion thereof to said top portion thereof, and wherein said spiral staircase extends generally vertically from a base plane to a top plane, said base plane defined by said base portion of said first freestandable support frame and said top plane defined by said top portion of said first freestandable support frame.

12. The apparatus of claim 1, wherein said second enclosure member comprises a drywall panel.

13. The apparatus of claim 1, wherein said first face of said first freestandable support frame exhibits an indentation arranged to receive a protruding portion of said at least one first enclosure member or said second enclosure member.

14. A hardenable material construction method, the method comprising:

positioning a first enclosure member in parallel with a second enclosure member such that a space is defined between an inner face of the first enclosure member and an inner face of the second enclosure member;

juxtaposing a first face of a first freestandable support frame with an outer face of the first enclosure member or an outer face of the second enclosure member such that the first face of the first freestandable support frame is substantially completely covered by the outer face of the first enclosure member or the outer face of the second enclosure member, the first freestandable support frame having a second face opposing the first face, the distance between the first face and the second face being at least 60 centimeters, the outer face of the first enclosure member opposing the inner face of the first enclosure member and the outer face of the second enclosure member opposing the inner face of the second enclosure member;

inserting at least one extension member through the first enclosure member and the second enclosure member such that a first end of the at least one extension member extends past the outer face of the first enclosure member or a second end of the at least one extension member, opposing the first end thereof, extends past the outer face of the second enclosure member;

securing the at least one extension member to the first freestandable support frame; and subsequent to said securing the at least one extension member to the first freestandable support frame, pouring hardenable material into the space defined between the first enclosure member and the second enclosure member.

15. The method of claim 14, further comprising:

juxtaposing a first face of a second freestandable support frame with the outer face of the second enclosure member such that the first face of the second freestandable support frame is substantially completely covered by the outer face of the second enclosure member, the second freestandable support frame having a second face opposing the first face, the distance between the first face and the second face of the second freestandable support frame being at least 60 centimeters, the first face of the first freestandable support frame juxtaposed with the outer face of the first enclosure member such that the first face of the first freestandable support frame is substantially completely covered by the outer face of the first enclosure member; and securing the at least one extension member to the second freestandable support frame such that the first end of the at least one extension member is secured to the first freestandable support frame and the second end of the at least one extension member is secured to the second freestandable support frame.

16. The method of claim 14, wherein the at least one extension member comprises a plurality of extension members, the method further comprising, prior to said pouring hardenable material:

a) positioning a first side of each of a plurality of slabs to face a second side of another of the plurality of slabs, the second side of each of the plurality of slabs opposing the first side thereof, the first side and second side of each of the plurality of slabs exhibiting a slit configured to receive a respective one of a plurality of strips;

b) disposing a respective one of the plurality of strips within the slit of the first side of each of the plurality of slabs and the slit of the second side of the respective another slab; and c) inserting each of the plurality of extension members through a respective one of the plurality of strips, wherein the first enclosure member is formed responsive to steps a-b, and wherein said inserting through the first enclosure member is responsive to step c.

17. The method of claim 16, further comprising disposing each of a plurality of L-shaped corner members, each exhibiting a first end and a second end perpendicular to the first end, within the slit of the first side of a first of the plurality of slabs and within the slit of the first side of a second of the plurality of slabs.

18. The method of claim 14, wherein the at least one extension member comprises a plurality of extension members, the method further comprising, prior to said pouring hardenable material, inserting each of the plurality of extension members through a respective one of a plurality of facade securing elements, each of the plurality of facade securing elements secured to a perimeter of a respective one of a plurality of facade members, wherein the first enclosure member comprises the plurality of facade members, and wherein said inserting through the first enclosure member is responsive to said inserting through said plurality of facade securing elements.

19. The method of claim 14, further comprising, prior to said pouring hardenable material:

d) positioning an outer face of an insulation layer to face an inner face of an outer layer so as to form the first enclosure member, wherein the outer layer exhibits an outer face opposing the inner face thereof, the outer face of the first enclosure member comprising the outer face of the outer layer, and wherein the insulation layer exhibits an inner face opposing the outer face thereof, the inner face of the first enclosure member comprising the inner face of the insulation layer.

20. The method of claim 19, wherein step d comprises positioning the outer face of the insulation layer to be in direct contact with the inner face of the outer layer.

21. The method of claim 19, further comprising, prior to said pouring hardenable material:

disposing a grid assembly within the space defined between the first enclosure member and the second enclosure member;

securing the insulation layer to the outer layer with a plurality of securing members, each of the plurality of securing members disposed on a respective one of the plurality of extension members; and securing the grid assembly to one of said plurality of extension members so as to separate the grid assembly from the insulation layer by at least a predetermined distance.

22. The method of claim 14, further comprising, prior to said pouring hardenable material:

juxtaposing a second freestandable support frame with the outer face of the second enclosure member, the first face of the first freestandable support frame juxtaposed with the outer face of the first enclosure member;

securing the at least one extension member to the second freestandable support frame such that the first end of the at least one extension member is secured to the first freestandable support frame and the second end of the at least one extension member is secured to the second freestandable support frame;

positioning a ceiling panel to be supported by an upper portion of the second freestandable support frame;

positioning a third freestandable support frame on top of the first freestandable support frame;

juxtaposing the third freestandable support frame with the outer face of the first enclosure member, the insulation layer of the first enclosure member rising above said positioned ceiling panel; and pouring hardenable material onto the ceiling panel, said pouring hardenable material into the space defined between the first enclosure member and the second enclosure member responsive to said pouring hardenable material onto said positioned ceiling panel.

23. The method of claim 22, wherein said positioned ceiling panel comprises a drywall panel, the method further comprising, prior to said pouring hardenable material onto said positioned ceiling panel, inserting a plurality of hardenable material securing members into the drywall panel such that each of the plurality of hardenable material securing members extends from within the drywall panel to a point above a face of the drywall panel.

24. The apparatus of claim 1, wherein said first freestandable support frame comprises a base portion, a first side of said base portion defined by said first face of said first freestandable support frame and a second side of said base portion defined by said second face of said first freestandable support frame, and wherein said base portion is generally rectangular shaped.

25. The apparatus of claim 24, wherein the dimensions of said generally rectangular base portion of said first freestandable support frame are about 60 centimeters by about 120 centimeters.

26. The apparatus of claim 25, wherein said first face of said first freestandable support frame is generally rectangular shaped, a first side of said first face of said first freestandable support frame defining said first side of said base portion and a second side of said first face of said first freestandable support frame generally orthogonal to said first side said first face of said first freestandable support frame, wherein said second side of said first face of said first freestandable support frame is longer than said first side said first face of said first freestandable support frame.

27. The apparatus of claim 25, wherein said second freestandable support frame comprises a base portion, a first side of said base portion defined by said first face of said second freestandable support frame and a second side of said base portion defined by said second face of said second freestandable support frame, wherein said base portion is generally rectangular shaped, and wherein the dimensions of said generally rectangular base portion of said second freestandable support frame are about 60 centimeters by about 120 centimeters.

28. The apparatus of claim 27, wherein said first face of said second freestandable support frame is generally rectangular shaped, a first side of said first face of said second freestandable support frame defining said first side of said base portion and a second side of said first face of said second freestandable support frame generally orthogonal to said first side said first face of said second freestandable support frame, wherein said second side of said first face of said second freestandable support frame is longer than said first side said first face of said second freestandable support frame.

* * * * *